US006745589B2

(12) United States Patent
Katatani et al.

(10) Patent No.: US 6,745,589 B2
(45) Date of Patent: Jun. 8, 2004

(54) SINGLE-PACKAGE AIR CONDITIONER

(75) Inventors: Tosiharu Katatani, Yao (JP); Mamoru Morikawa, Yamatokouriyama (JP); Yukishige Shiraichi, Yao (JP); Masaki Ohtsuka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/138,377

(22) Filed: May 6, 2002

(65) Prior Publication Data

US 2003/0094010 A1 May 22, 2003

(30) Foreign Application Priority Data

Nov. 22, 2001 (JP) ..... 2001-357772
Nov. 22, 2001 (JP) ..... 2001-357813
Feb. 15, 2002 (JP) ..... 2002-037673

(51) Int. Cl.[7] ..... F25D 23/12
(52) U.S. Cl. ..... 62/259.1; 62/298
(58) Field of Search ..... 62/71, 259.1, 298, 62/150, 404

(56) References Cited

U.S. PATENT DOCUMENTS 4,100,764 A * 7/1978 Murano ..... 62/289
4,457,140 A * 7/1984 Rastelli ..... 62/261
5,044,260 A * 9/1991 Avari ..... 98/40.28
5,444,990 A * 8/1995 McGill et al. ..... 62/298
5,823,009 A * 10/1998 Suzuki et al. ..... 62/410
5,911,742 A * 6/1999 Akazawa ..... 62/78
5,958,114 A * 9/1999 Sunahara et al. ..... 96/417
6,065,296 A 5/2000 Feger
6,185,954 B1 * 2/2001 Smiley, III et al. ..... 62/426
6,336,338 B1 * 1/2002 Koren ..... 62/262
6,405,543 B2 * 6/2002 Kopko ..... 62/89

* cited by examiner

*Primary Examiner*—Melvin Jones
(74) *Attorney, Agent, or Firm*—Birch, Stewart, Kolasch & Birch, LLP

(57) ABSTRACT

A single-unit air conditioner has a housing and a cooler/heater unit housed in it. The cooler/heater unit can be put into and taken out of the housing with the housing kept connected to an air conditioning duct. Of the four panels forming the four side faces of the housing, three other than the one facing a wall can be removed individually from the housing. The cooler/heater unit has an indoor heat exchanger unit including an indoor blower, which is housed in a fan casing having an outflow opening that can be widened by removing a member so that the outflow opening can be used as an opening through which to maintain a fan. The indoor heat exchanger unit includes heating means for heating, which can be fitted and removed through either of the left-hand and right-hand side faces of the housing. Inside the housing are provided an indoor air passage and an outdoor air passage, of which at least part is partitioned by a partitioning member. The partitioning member has a portion thereof formed into a curved-surface portion, which guides the wind passing through one of the indoor and outdoor air passages.

14 Claims, 26 Drawing Sheets

SINGLE-PACKAGE AIR CONDITIONER

BACKGROUND OF THE INVENTION

1. Field of the Invention

The present invention relates to an air conditioner, and more particularly to a single-package air conditioner having an indoor heat exchanger unit and an outdoor heat exchanger unit housed in a single housing.

2. Description of the Prior Art

There are many types of air conditioner. For example, some air conditioners are of a "separate type" having an indoor unit and an outdoor unit built in separate packages. This type of air conditioner is inconvenient to use in a building that does not permit the outdoor unit to be readily installed outside it, such as a hotel or a building located in a heavily inhabited area. In such buildings, it is customary to use single-package air conditioners having an indoor heat exchanger unit and an outdoor heat exchanger unit housed in a single housing.

Among single-package air conditioners as described above, smaller models designed to cool and heat one room are typically installed by being fitted directly in a window or in an opening formed in a wall. By contrast, larger models of single-package air conditioners designed to cool and heat a plurality of rooms are generally installed by being placed on a deck formed so as to protrude into a room from a wall facing outdoors or on a stand placed by a window in a room. U.S. Pat. No. 6,065,296 discloses an example in which a single-package air conditioner is placed on a deck formed so as to protrude from a vent provided in a wall.

A problem with single-package air conditioners like the one disclosed in U.S. Pat. No. 6,065,296 is that they are considerably heavy and require much labor to lift them up, making their installation difficult. Another problem is that it is not easy to connect air conditioning ducts and drain hoses to single-package air conditioners.

In larger models of single-package air conditioners as described above, the housing is commonly built by joining together panels of sheet metal. Joining panels together produces rectangular corners. Air passages are no exception. As air flows through an air passage, eddies of wind are produced in the rectangular corners of the air passage. Thus, another problem is that such eddies of wind increase the draft resistance of air passages and increase blowing noise.

SUMMARY OF THE INVENTION

An object of the present invention is to facilitate the installation of a single-package air conditioner having an indoor heat exchanger unit and an outdoor heat exchanger unit housed in a single housing. Another object of the present invention is to provide a single-package air conditioner that permits easy recovery from failure and easy regular maintenance. Still another object of the present invention is to provide a single-package air conditioner that operates with reduced draft resistance of outdoor and/or indoor air passages and with reduced blowing noise.

To achieve the above objects, according to the present invention, a single-package air conditioner having an indoor heat exchanger unit and an outdoor heat exchanger unit housed in a single housing is structured in the following manner. The indoor heat exchanger unit and the outdoor heat exchanger unit together constitute a single cooler/heater unit. Moreover, the housing is connected to an air conditioning duct suspended from above. Furthermore, the cooler/heater unit can be put into and taken out of the housing with the housing kept connected to the air duct. With this structure, it is possible to install only the housing first, and then insert the cooler/heater unit in the housing to complete the installation. This helps reduce the weight to lift up as compared with when handling a single-unit air conditioner in a fully assembled state, and thus makes installation easier.

According to the present invention, the housing has its four side faces formed of four panels, of which three other than the one facing a wall are individually removable from the housing. With this structure, the cooler/heater unit can be put in and taken out of the housing through whichever of the front, left-hand side, and right-hand side faces thereof is most convenient. This makes installation and checking easy.

According to the present invention, in the housing is provided a duct that connects to the air conditioning duct and whose height is variable inside the housing. With this structure, the duct is raised when the cooler/heater unit is put in and taken out and, once the cooler/heater unit is placed in position, the duct is lowered and connected to the cooler/heater unit. This permits easy connection between the cooler/heater unit and the duct.

According to the present invention, the cooler/heater unit is provided with a drain pan for collecting the drain water produced in the cooler/heater unit, and the housing is provided with a water collecting sink for collecting and discharging the drain water from the drain pan of the cooler/heater unit. With this structure, it is possible to reliably collect drain water and discharge it out of the air conditioner. Moreover, the cooler/heater unit can be built as a unit including a drain pan so that it can be put into and taken out of the housing together with the drain pan.

According to the present invention, the housing can be connected to the air conditioning duct without the cooler/heater unit housed in the housing. With this structure, the housing can be connected to the air conditioning duct easily. Moreover, when the cooler/heater unit is checked, it can be taken out and put into the housing with the housing kept connected to the air conditioning duct. This makes checking easy.

According to the present invention, the housing can be connected to a drain hose without the cooler/heater unit housed in the housing. With this structure, the housing can be connected to the drain hose easily. Moreover, when the cooler/heater unit is checked, it can be taken out and put into the housing with the housing kept connected to the drain hose. This makes checking easy.

According to the present invention, in a single-package air conditioner having a cooler/heater unit housed in a housing, when a component forming part of a blower fan casing included in the cooler/heater unit is removed, an opening appears through which to maintain a fan provided inside the blower fan casing. With this structure, the fan can be maintained without touching the components arranged in front of the blower, and thus the fan can be maintained easily.

According to the present invention, in a single-package air conditioner having a cooler/heater unit housed in a housing, heating means for heating is arranged inside the housing, and the heating means can be fitted and removed through either of the left-hand and right-hand side faces of the housing. With this structure, the heating means can be fitted and removed through either of the left-hand and right-hand side faces of the housing. Even when the single-package air conditioner is installed in a corner of a room, the heating means can be fitted and removed through either of the left-hand and right-hand side faces. This makes checking and repair of the heating means easy.

According to the present invention, the heating means is fixed in position with one end thereof engaged with an engagement recess inside the housing and with the other end thereof fastened with a screw to a member provided inside the housing. With this structure, the heating means can be fixed in position with a few screws, which helps reduce the costs of components and assembly.

According to the present invention, temperature sensing means for controlling the energization of the heating means is arranged above the heating means, and the temperature sensing means has the temperature sensing portion thereof housed in a container having a vent through which to allow a flow of hot air in from the heating means. With this structure, the flow of hot air has sufficiently uniform temperature to permit stable temperature sensing.

According to the present invention, in a single-package air conditioner having a cooler/heater unit housed in a housing, when the cooler/heater unit is inserted in the housing, a hermetic connection portion is formed between a vent opening formed in the housing and the cooler/heater unit. With this structure, it is possible to minimize leakage of wind and thereby make efficient use of energy.

According to the present invention, a single-package air conditioner has a housing in which are housed an indoor heat exchanger for exchanging heat with air inside a room, an indoor blower for blowing air into the room, an indoor air passage through which wind produced by the indoor heat exchanger is passed, an outdoor heat exchanger for exchanging heat with air outside the room, an outdoor blower for blowing air out of the room, an outdoor air passage through which wind produced by the outdoor heat exchanger is passed, and a partitioning member for partitioning at least part of the indoor and outdoor air passages. Here, the partitioning member has a portion thereof formed into a curved-surface portion for guiding the wind passing through one of the indoor and outdoor air passages. With this structure, the wind passing through one of the indoor and outdoor air passages is guided by the partitioning member having the curved-surface portion. Thus, it is possible to guide wind with a comparatively inexpensive, simple structure without providing additional components and thereby prevent development of eddies of wind that cause blowing noise. In this way, it is possible to reduce blowing noise.

According to the present invention, the curved-surface portion serves also as a diffuser portion for diffusing the wind passing through the other of the indoor and outdoor air passages. With this structure, the direction of wind is changed smoothly by one surface of the curved-surface portion of the partitioning member, and a diffusing effect is exerted by the other surface thereof This helps reduce the draft resistance of both the indoor and outdoor air passages, and in addition reduce the blowing noise of both the indoor and outdoor air passages. All this is achieved with an inexpensive structure.

According to the present invention, the curved-surface portion faces an outdoor inflow opening, and has an arc-shaped section whose radius R satisfies $\min(Ra, Rb) \geqq R$, where Ra represents the dimension of the portion of the outdoor inflow opening facing the partitioning member and Rb represents the dimension of the outdoor air passage. With this structure, it is possible to reduce draft resistance and blowing noise more effectively.

In addition, the dimensions mentioned above satisfy $Rb \geqq Ra$ and $R \approx Ra$ as well. With this structure, it is possible to reduce draft resistance and blowing noise even more effectively.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Hereinafter, a first embodiment of the present invention will be described with reference to FIGS. 1 to 24.

Figure 1:
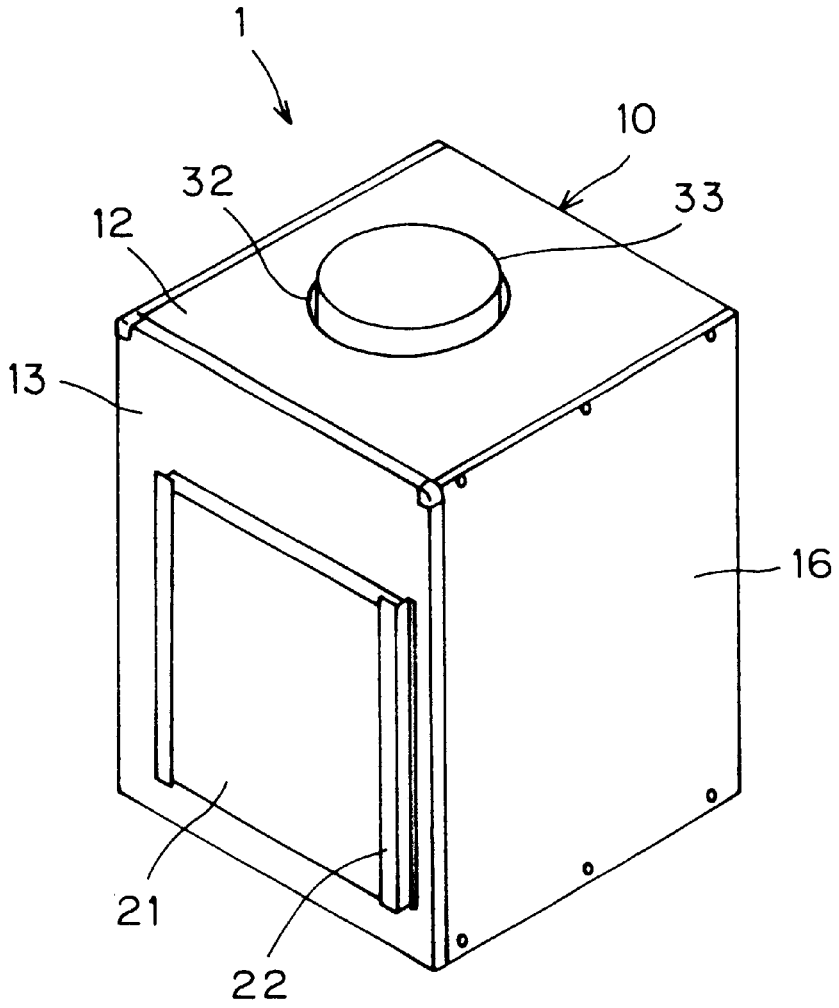
FIG. 1 is a perspective view of the single-package air conditioner of a first embodiment of the invention.

FIG. 1 shows an external appearance of a single-package air conditioner 1. The single-package air conditioner 1 has a housing 10 having the shape of a rectangular parallelepiped. The structure of the housing 10 will be described later.

Figure 2:
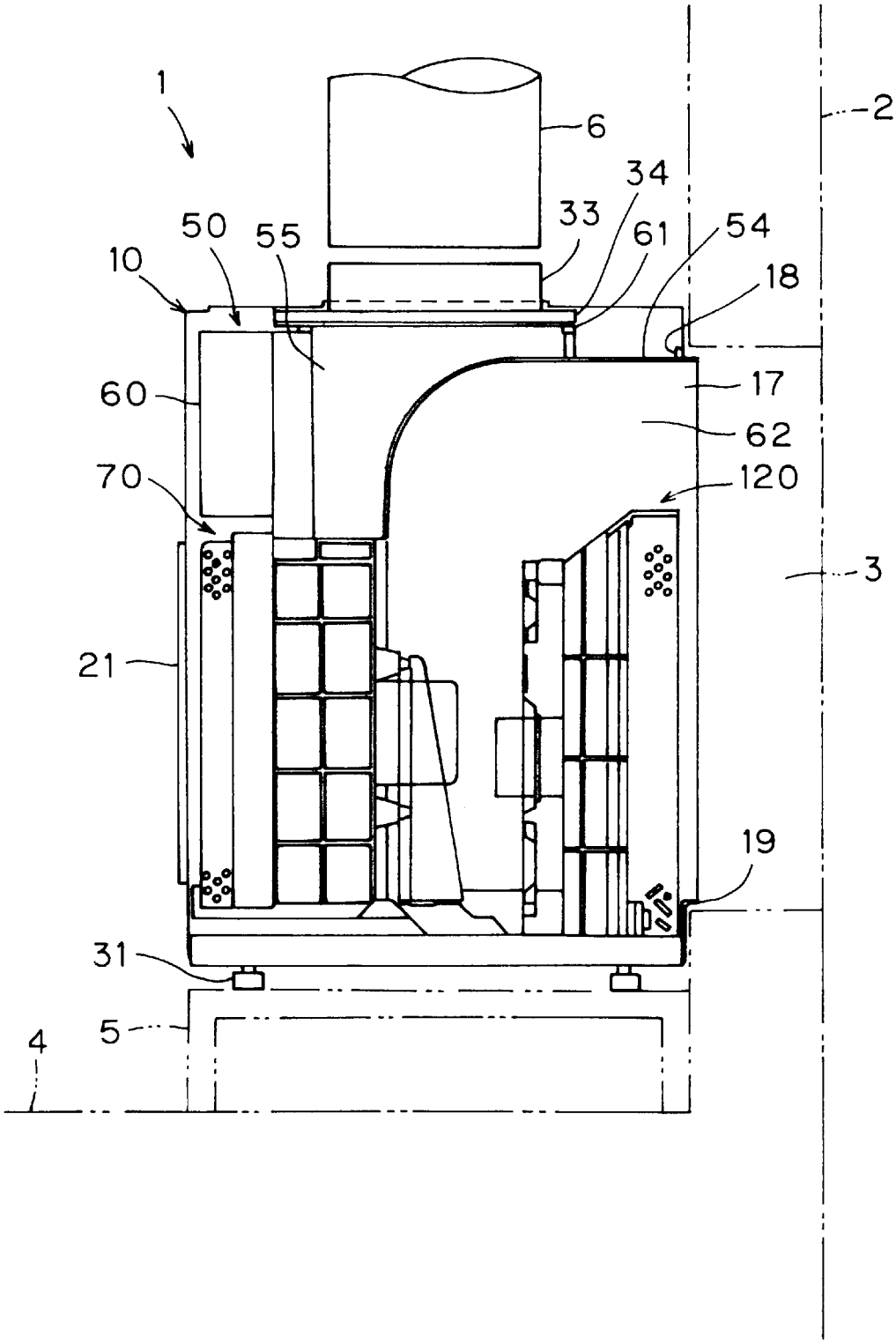
FIG. 2 is a vertical sectional view of the single-package air conditioner.
Figure 3:
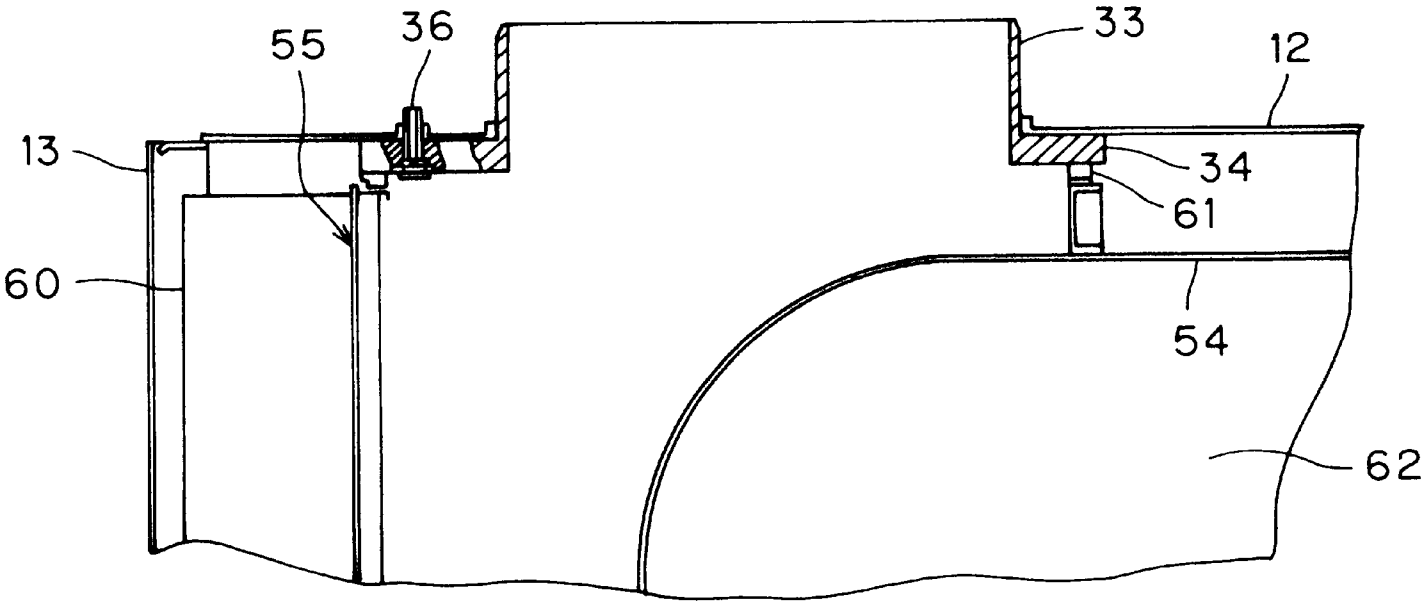
FIG. 3 is an enlarged view of a portion of FIG. 2.

As shown in FIG. 2, in the housing 10 is housed a cooler/heater unit 50 including an indoor heat exchanger unit 70 and an outdoor heat exchanger unit 120. From inside a room, the housing 10 is pressed against a ventilation opening 3 formed in a wall 2 separating the inside of the room and the outdoors. To adjust the height of a vent opening of the housing 10 to that of the ventilation opening 3, the housing 10 is mounted on a support stand 5 placed on a floor 4.

In the room, an air conditioning duct 6 is suspended vertically from above. A duct 33 provided so as to protrude from the top face of the housing 10 is connected to the air conditioning duct 6. In the ceiling portion of the room, the air conditioning duct 6 is connected to a horizontal air conditioning duct (not illustrated) so that cooled or heated air is supplied through this horizontal air conditioning duct to a plurality of rooms.

Figure 5:
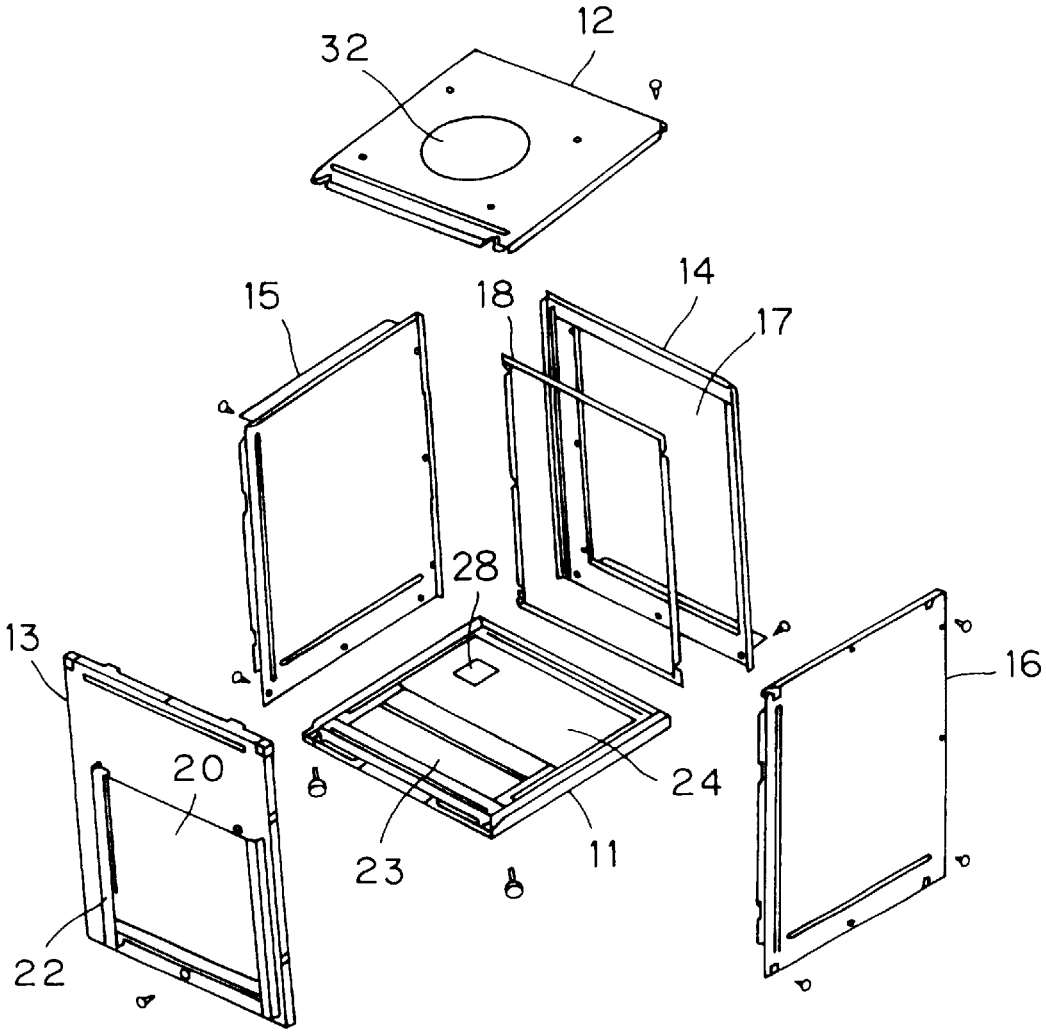
FIG. 5 is an exploded perspective view of the housing of the single-package air conditioner.
Figure 6:
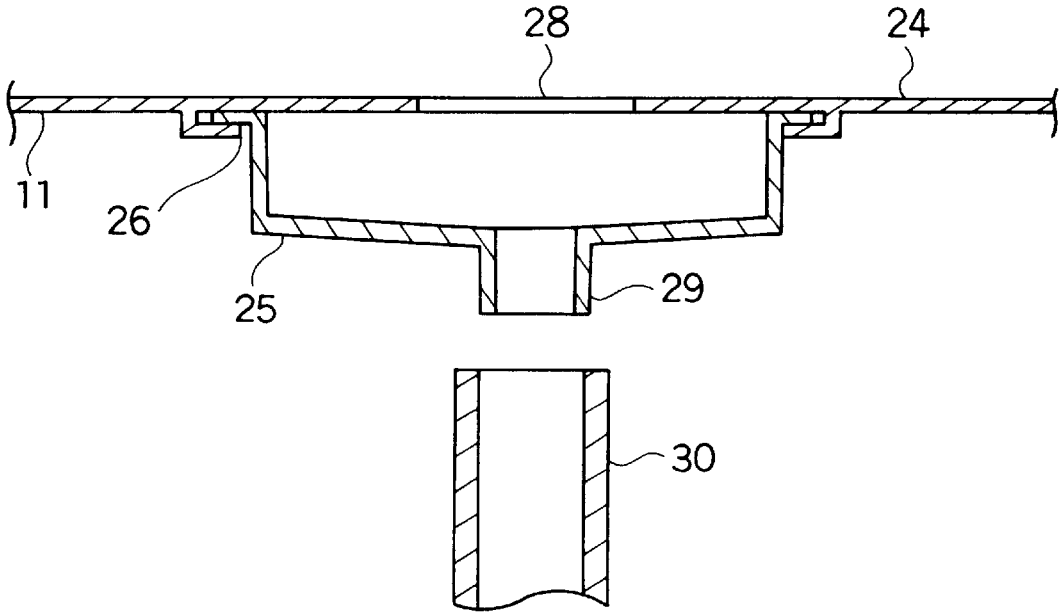
FIG. 6 is an enlarged vertical sectional view of a portion of the housing.

The housing 10 has, as described above, the shape of a rectangular parallelepiped, and its six faces are composed of the following six panels shown in FIG. 5: a bottom panel 11, a top panel 12, a front panel 13, a rear panel 14, a left side panel 15, and a right side panel 16. These panels are all formed out of sheet metal, and they are assembled into the housing 10 by being fixed to one another with screws.

Even after the housing 10 has been assembled, of the four panels forming the four side faces of the housing 10, i.e. the front, rear, left side, and right side panels 13, 14, 15, and 16, three other than the rear panel 14 facing the wall 2, i.e. the front, left side, and right side panels 13, 15, and 16 are individually removable from the housing 10. The individual panels are designed to have sufficient mechanical strength so that, even when one of those three panels is removed, the rest of the panels maintain the shape of the housing 10 and bear the loads imposed thereon.

The rear panel 14 has a large rectangular vent opening 17, and thus has a frame-like shape. The vent opening 17 is given a sufficiently large area to permit the outflow portion of the outdoor heat exchanger unit 120 to be exposed toward outside the room, and in addition to secure an inflow passage (described later) through which air is sucked in from outside the room.

On the inner surface of the rear panel 14, a gasket 18 shaped like a frame is fitted so as to surround the vent opening 17. As will be described later, the gasket 18 forms a hermetic connection portion between the rear panel 14 and the cooler/heater unit 50. On the rear surface of the rear panel 14, a protruding portion 19 (see FIG. 2) shaped like a rectangular loop is formed so as to surround the vent opening 17. The protruding portion 19 fits in the ventilation opening 3 and prevents air from flowing in and out through the gap between the single-package air conditioner 1 and the wall 2.

The front panel 13 has a rectangular vent opening 20 formed therein. The vent opening 20 permits air to be sucked into the housing 10 from inside the room. In front of the vent opening 20 is arranged a filter 21 (see FIG. 1), which filters out dust from the air sucked in. The filter 21 is composed of a filtering material supported on a rectangular frame, and is held by a filter holder 22 provided on the front panel 13.

The filter holder 22 is composed of two L angles formed out of sheet metal which are welded, or fitted with screws, along the left and right side portions of the rim of the vent opening 20 so as to face each other. At the bottom end of each L angle is formed a stopper so that the filter 21 inserted in the filter holder 22 from above is held at the height of the vent opening 20.

The bottom panel 11 has a rectangular opening 23 in the front portion thereof The rear portion of the bottom panel 11 is made deeper than the front portion thereof so as to form a basin 24. In the basin 24 is provided a drain opening 28 through which to discharge the drain water from the cooler/heater unit 50. The drain water discharged through the drain outlet 28 is collected in a water collecting sink 25 (see FIG. 6) fitted on the bottom surface of the bottom panel 11.

The water collecting sink 25 is formed separately from the bottom panel 11, and is supported on the bottom panel 11 with flanges of the water collecting sink 25, which are formed at the rim thereof so as to extend outward, inserted into troughs 26 that are formed on the bottom surface of the bottom panel 11 so as to face each other. The troughs 26 are formed by welding, or fitting with screws, angles formed out of sheet metal so as to have a Z-shaped section to the bottom panel 11. Since the water collecting sink 25 is supported by the troughs 26, it can be slid in the direction of the depth of FIG. 6 to adjust its position when the air conditioner is installed. To an outflow port 29 of the water collecting sink 25, a drain hose 30 is connected. Through the drain hose 30, drained water is discharged to a sewage inlet provided inside the room or to outside the room.

On the bottom surface of the bottom panel 11, screw-type adjustable feet 31 are provided in the four corners (see FIG. 2). After the housing 10 is mounted on the support stand 5, the adjustable feet 31 provided in four positions are rotated individually to adjust their heights and thereby level the housing 10.

Figure 7:
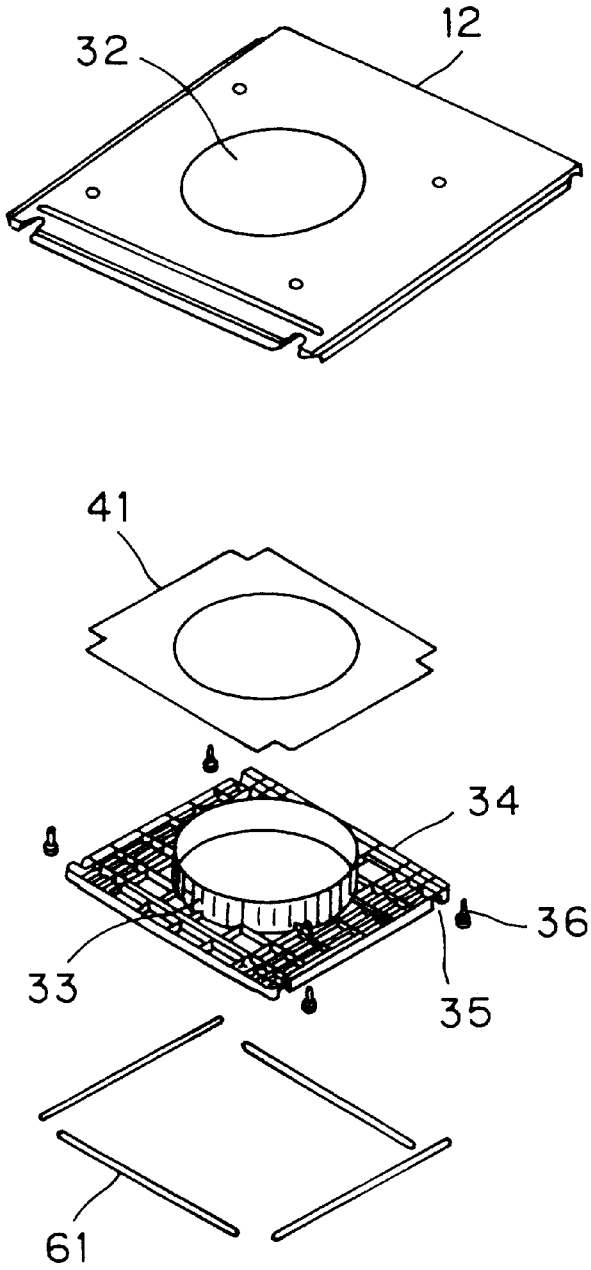
FIG. 7 is an exploded perspective view of the top panel of the housing.

FIG. 7 shows the structure of the top panel 12. The top panel 12 has a circular opening 32 formed substantially at the center. Through this opening 32, a cylindrical duct 33 protrudes from inside the housing 10. The duct 33 is formed out of synthetic resin integrally with a rectangular duct base 34.

Figure 8:
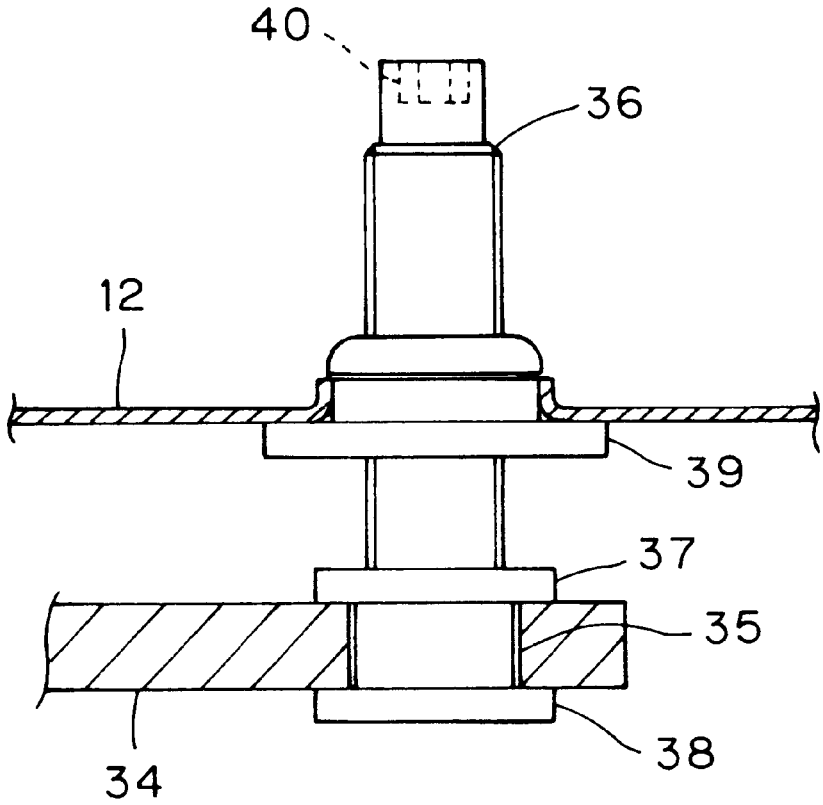
FIG. 8 is an enlarged vertical sectional view of a portion of the top panel.

The duct base 34 has cuts 35 in the four corners, and through these cuts 35 are put fitting bolts 36 shown in FIG. 8. The fitting bolts 36 are arranged with their axes vertical. Each fitting bolt 36 has, at the lower end thereof, two flanges 37 and 38 arranged with an interval secured vertically in between, and is put in one of the cuts 35 with the duct base 34 sandwiched between those flanges 37 and 38. The cuts 35 are made narrower at their entrances to prevent the fitting bolts 36 from coming out easily.

To the top panel 12, nuts 39 are fixed in four positions in total around the opening 32, and the fitting bolts 36 are screw-engaged with these nuts 39 from below. Each fitting bolt 36 has a groove or socket 40 formed at the upper end thereof so as to receive a tightening tool such as a cross head screwdriver or hexagonal wrench. When the fitting bolt 36 is rotated with the tip of a tightening tool put in the socket 40, the fitting bolt 36 moves upward or downward relative to the nut 39. This permits the height of the duct 33 and the duct base 34 inside the housing 10 to be varied.

Between the top panel 12 and the duct base 34 is inserted a heat insulating plate 41. The heat insulating plate 41 is formed out of a material that is a good insulator of heat, such as styrene foam. The purpose of arranging the heat insulating plate 41 here is to prevent the top panel 12 from being cooled and thereby prevent condensation on the surface of the top panel 12 when the duct base 34 is cooled by cooled air.

Next, the structure of the cooler/heater unit 50 will be described with reference to FIGS. 9 to 24. The cooler/heater unit 50 includes an indoor heat exchanger unit 70 and an outdoor heat exchanger unit 120. The indoor heat exchanger unit 70 and the outdoor heat exchanger unit 120 achieve heat exchange through the operation of a refrigerating cycle portion 51 shown in FIG. 10.

The refrigerating cycle portion 51 is provided with an indoor heat exchanger 71, an outdoor heat exchanger 121, and a compressor 52. These components are connected together with metal tubes 53. The refrigerating cycle portion 51 includes a four-way valve (not illustrated) so that the indoor heat exchanger 71 and the outdoor heat exchanger 121 exchange their functions between in cooling operation and in heating operation.

Figure 9:
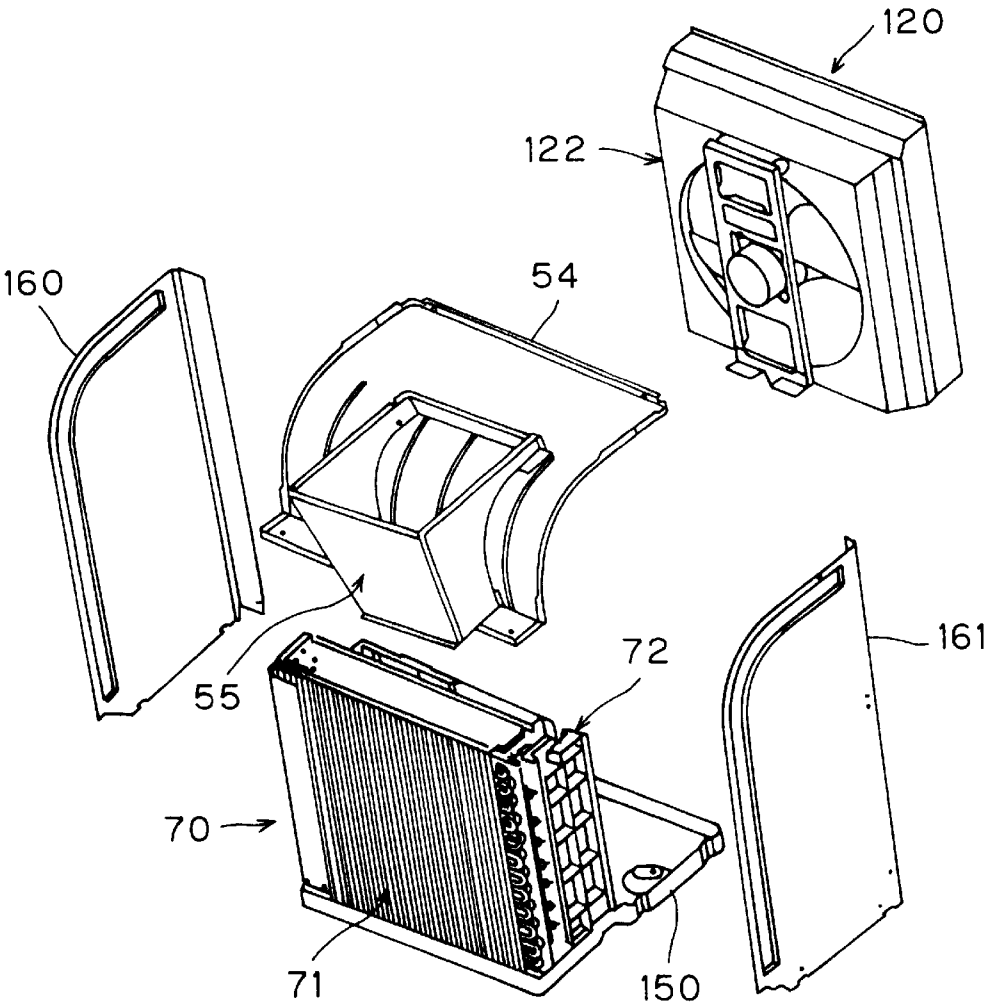
FIG. 9 is an exploded perspective view of the cooler/heater unit of the single-package air conditioner.
Figure 10:
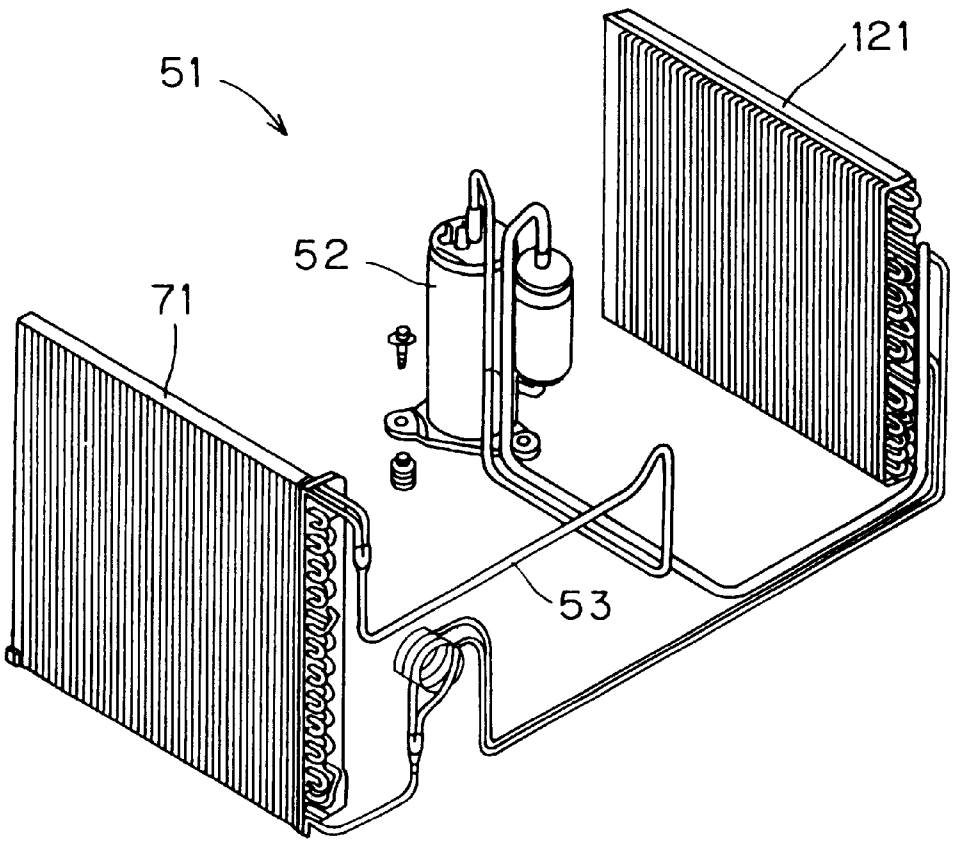
FIG. 10 is a perspective view of the refrigerating cycle portion of the single-package air conditioner.

As shown in FIG. 9, the indoor heat exchanger 71 is combined with an indoor blower 72 to form the indoor heat exchanger unit 70; the outdoor heat exchanger 121 is combined with an outdoor blower 122 to form the outdoor heat exchanger unit 120. The indoor heat exchanger unit 70 and the outdoor heat exchanger unit 120 are placed on and fixed to a base 150 shaped like a tray.

Above the indoor blower 72 is fixed a wind guide 54 of which the shape as seen from the side is so curved as to form an arc. The wind guide 54 is formed out of sheet metal, and serves to guide the air sucked in from outside the room toward the inflow side of the outdoor blower 122.

Figure 11:
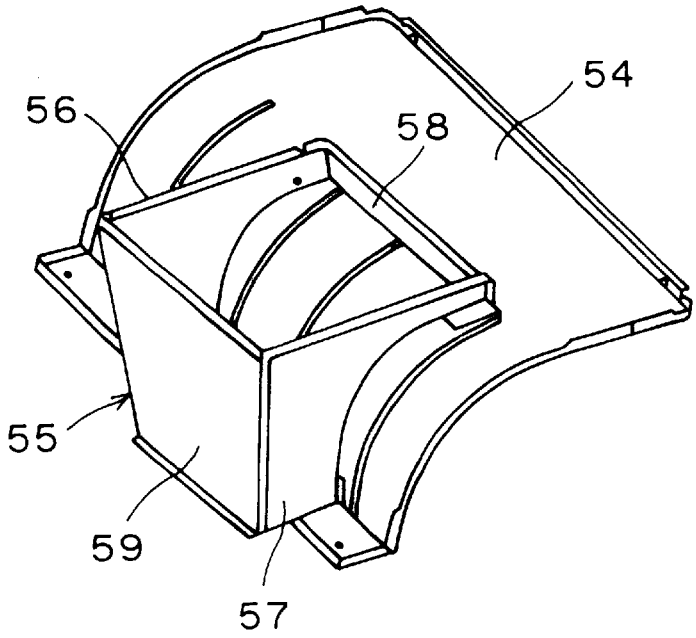
FIG. 11 is a perspective view of the wind guide and wind duct of the single-package air conditioner.

On the front surface of the wind guide 54 is provided a wind duct 55 for the indoor blower 72. As shown in FIG. 11, the wind duct 55 is formed by fixing four sheet metal members 56, 57, 58, and 59 to the wind guide 54, and has a rectangular horizontal section. The wind duct 55 serves to guide the wind sent out from the indoor blower 72 to the duct 33. The wind duct 55 is so formed as to be narrow at the bottom and increasingly wide toward the top to adapt to different areas of the outflow opening of the indoor blower 72 and the duct 33.

To the front surface of the wind duct 55, an electric component box 60 (see FIGS. 2 and 3) is fitted. On the bottom surface of the duct base 34, a gasket 61 is fitted (see FIGS. 2, 3, 7, and 15). The gasket 61 is arranged in the shape of a rectangular loop, i.e. in the same shape as the opening at the top of the wind duct 55.

Figure 4:
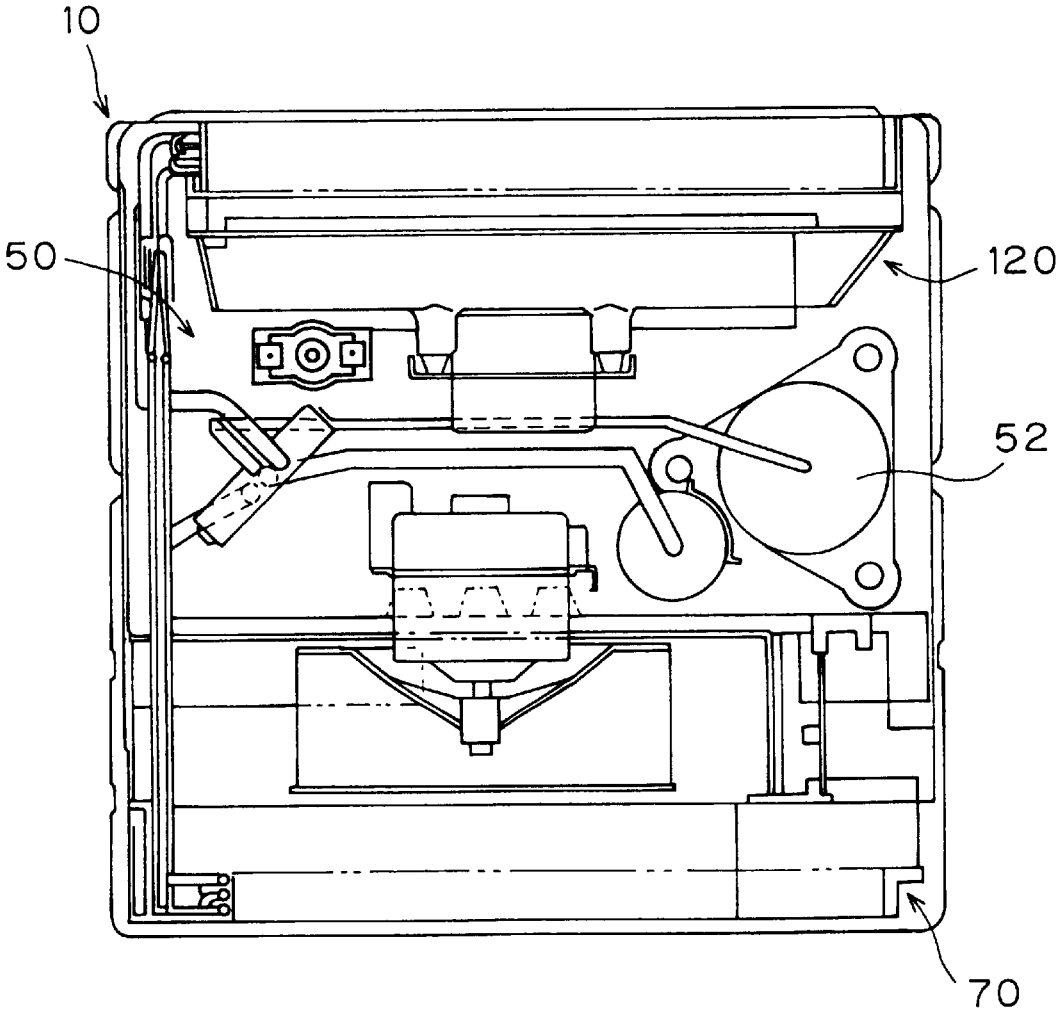
FIG. 4 is a horizontal sectional view of the single-package air conditioner.

In the space between the indoor heat exchanger unit 70 and the outdoor heat exchanger unit 120 is arranged a compressor 52, which is fixed to the base 150 (see FIG. 4). This space between the indoor heat exchanger unit 70 and the outdoor heat exchanger unit 120 and the side faces of the outdoor heat exchanger unit 120 are covered with a left side plate 160 and a right side plate 161 (see FIGS. 9 and 12). The upper front corners of the left and right side plates 160 and 161 are rounded so as to fit the curvature of the wind guide 54.

Figure 12:
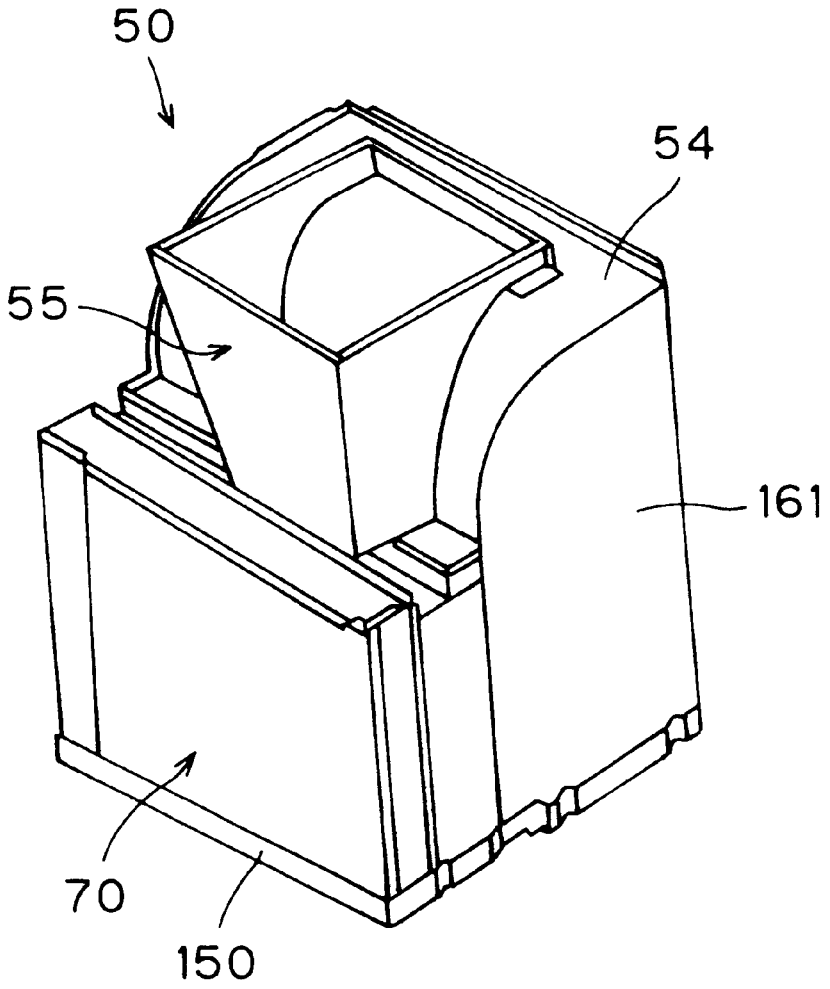
FIG. 12 is a perspective view of the cooler/heater unit in its assembled state.

FIG. 12 shows the cooler/heater unit 50 in its state in which the indoor heat exchanger unit 70 and the outdoor heat exchanger unit 120 are fixed to the base 150 and the wind guide 54 and the left and right side plates 160 and 161 are fitted thereto. Thus, FIG. 12 shows the cooler/heater unit 50 in its fully assembled state.

Next, the structure of the indoor heat exchanger unit 70 will be described in detail with reference to FIGS. 13 to 20.

The indoor heat exchanger unit 70 is composed essentially of an indoor heat exchanger 71, an indoor blower 72, and a heating means 73. These components all have a rectangular shape as seen from the front, and they are arranged in the following order from the front to the rear: the indoor heat exchanger 71, the heating means 73, and the indoor blower 72.

Figure 14:
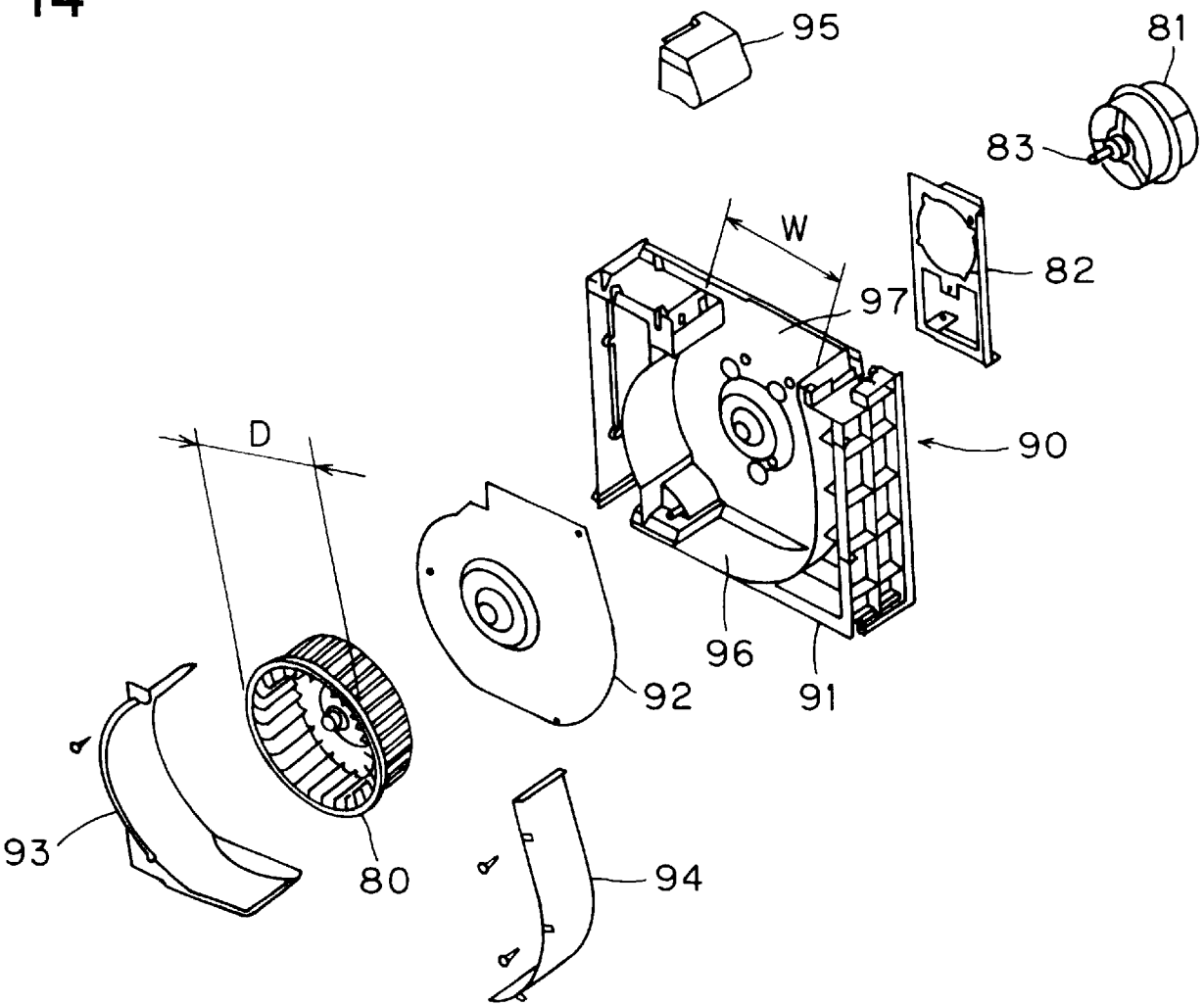
FIG. 14 is an exploded perspective view of the indoor blower of the cooler/heater unit.
Figure 15:
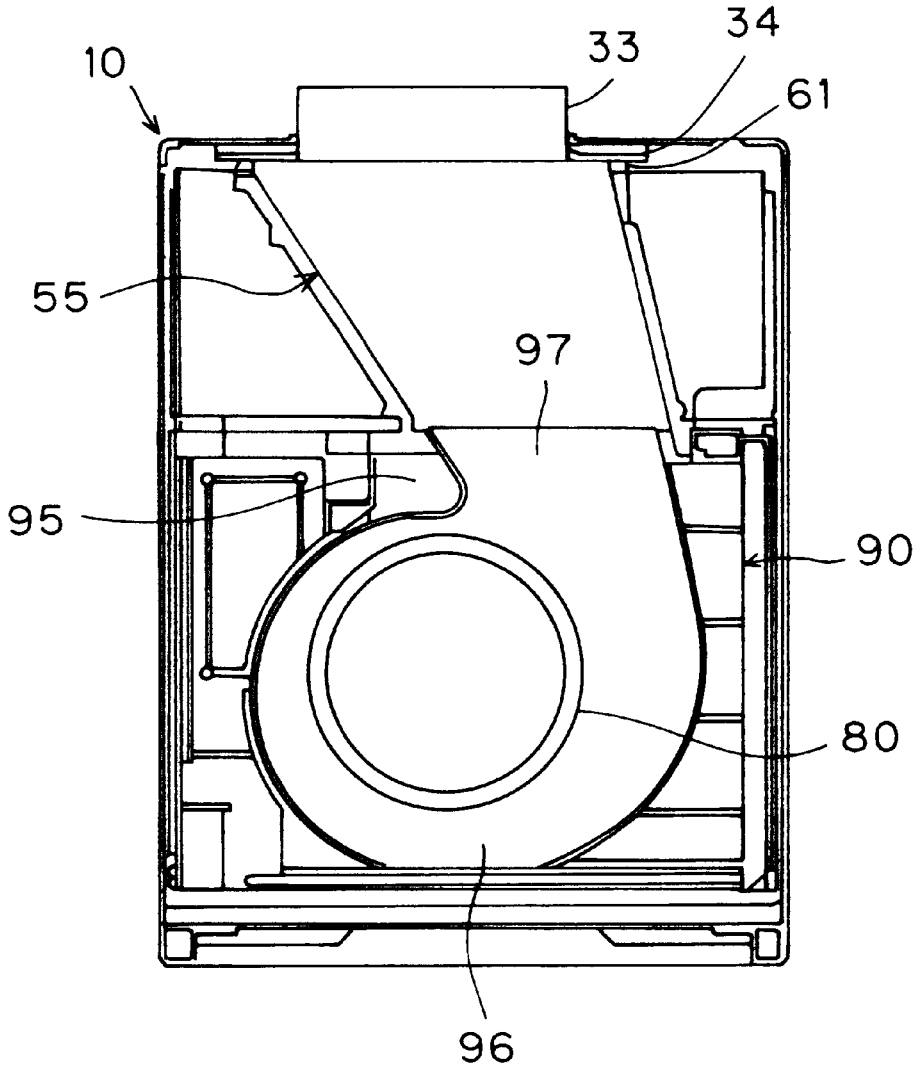
FIG. 15 is a vertical sectional view of the single-package air conditioner, showing the connection between the indoor blower and the wind duct.

As shown in FIG. 14, the indoor blower 72 is provided with a sirocco fan 80, a motor 81 for rotating the sirocco fan 80, and a fan casing 90. The motor 81 is fixed to the fan casing 90 through a metal fitting frame 82, with a motor spindle 83 protruding into a fan chamber (described later) inside the fan casing 90. The sirocco fan 80 is fixed to the motor spindle 83 with a screw (not illustrated). This screw is screwed, in the boss portion of the sirocco fan 80 at the center thereof, into the motor spindle 83 perpendicularly thereto.

The fan casing 90 is composed of the following components combined together; a casing body 91, a fan chamber rear plate 92, a fan chamber left guide plate 93, a fan chamber right guide plate 94, and a guide member 95.

The casing body 91 is molded out of synthetic resin, and has a fan chamber 96, for housing the sirocco fan 80, formed therein. The fan chamber 96 is open frontward and upward. To the inner surface of the fan chamber 96 are fixed the fan chamber rear plate 92, the fan chamber left guide plate 93, and the fan chamber right guide plate 94. The fan chamber rear plate 92 and the fan chamber right guide plate 94 are made of metal. The fan chamber left guide plate 93 is made of synthetic resin. The guide member 95, the fan chamber left guide plate 93, and the fan chamber right guide plate 94 together form a guide wall with an involute curve which encloses the sirocco fan 80.

As described above, the fan chamber 96 is open upward to form an outflow opening 97. To this outflow opening 97 connects the entrance of the wind duct 55 (see FIG. 15). The fan chamber right guide plate 94 forms one side of the outflow opening 97, and the guide member 95 forms the other side of the outflow opening 97.

The guide member 95 can be removed alone from the casing body 91. With the guide member 95 fitted, the width of the outflow opening 97 is smaller than the diameter D of the sirocco fan 80 (see FIG. 14), and therefore the sirocco fan 80 cannot be taken out through the outflow opening 97. With the guide member 95 removed, the width of the outflow opening 97 is W, which is larger than D, and therefore the sirocco fan 80 can be taken out through the outflow opening 97.

Figure 17:
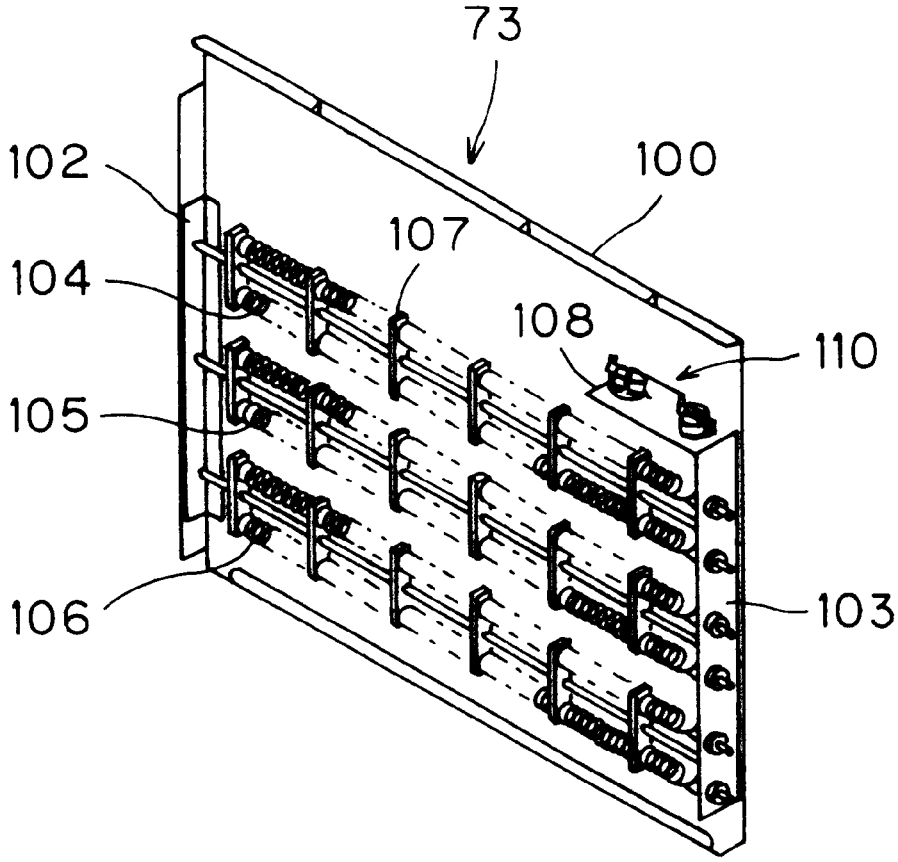
FIG. 17 is a perspective view of the heating means of the single-package air conditioner.

The heating means 73 arranged between the indoor heat exchanger 71 and the indoor blower 72 is structured as follows. In FIG. 17, reference numeral 100 represents an orifice plate made of metal. The orifice plate 100 has a rectangular shape as seen from the front, and has a circular vent opening 101 formed in the portion thereof located in front of the sirocco fan 80 (see FIG. 18). The diameter of the vent opening 101 is equal to or slightly smaller than that of the inflow portion of the sirocco fan 80.

On the front surface of the orifice plate 100, a pair of left and right heater mounting plates 102 and 103 are fitted. The heater mounting plates 102 and 103 are formed of metal L angles, and are fixed vertically along the left and right side edges of the orifice plate 100. Between the heater mounting plates 102 and 103, three heaters 104, 105, and 106 are stretched horizontally. The heaters 104, 105, and 106 are each composed of two coils of nickel-chromium-iron alloy (Nichrome™) wire, and they are arranged at regular intervals from top to bottom. The coils of nickel-chromium-iron alloy wire are supported here and there by insulators 107 of porcelain to prevent contact between the coils of nickel-chromium-iron alloy wire themselves and their contact with the orifice plate 100.

The top end of the heater mounting plate 103 is bent horizontally and is thereby formed into a temperature sensing means mounting portion 108. On the temperature sensing means mounting portion 108 is mounted a temperature sensing means 110, which senses the heat generated by the heaters 104, 105, and 106 to control the energization of the heaters 104, 105, and 106.

Figure 19:
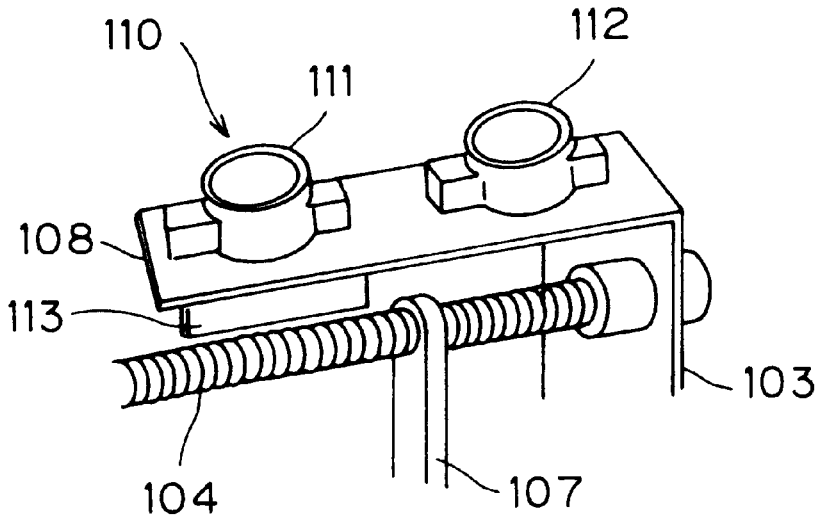
FIG. 19 is a perspective view of the temperature sensing portion of the single-package air conditioner.

In this embodiment, the temperature sensing means 110 is composed of two thermostats 111 and 112 (see FIG. 19). One thermostat 111 monitors the rising and falling of temperature to turn off and on the energization of the heaters 104, 105, and 106. The other thermostat 112, on detection of abnormal temperature, stops the operation of the single-package air conditioner 1. The thermostat 111 has its temperature sensing portion located in a position where it is exposed to the heat radiated from the heaters 104, 105, and 106 and the flow of hot air therefrom. For the thermostat 111, a container 113 formed out of sheet metal is fixed to the bottom surface of the temperature sensing means mounting portion 108 so as to enclose the temperature sensing portion of the thermostat 111.

Figure 18:
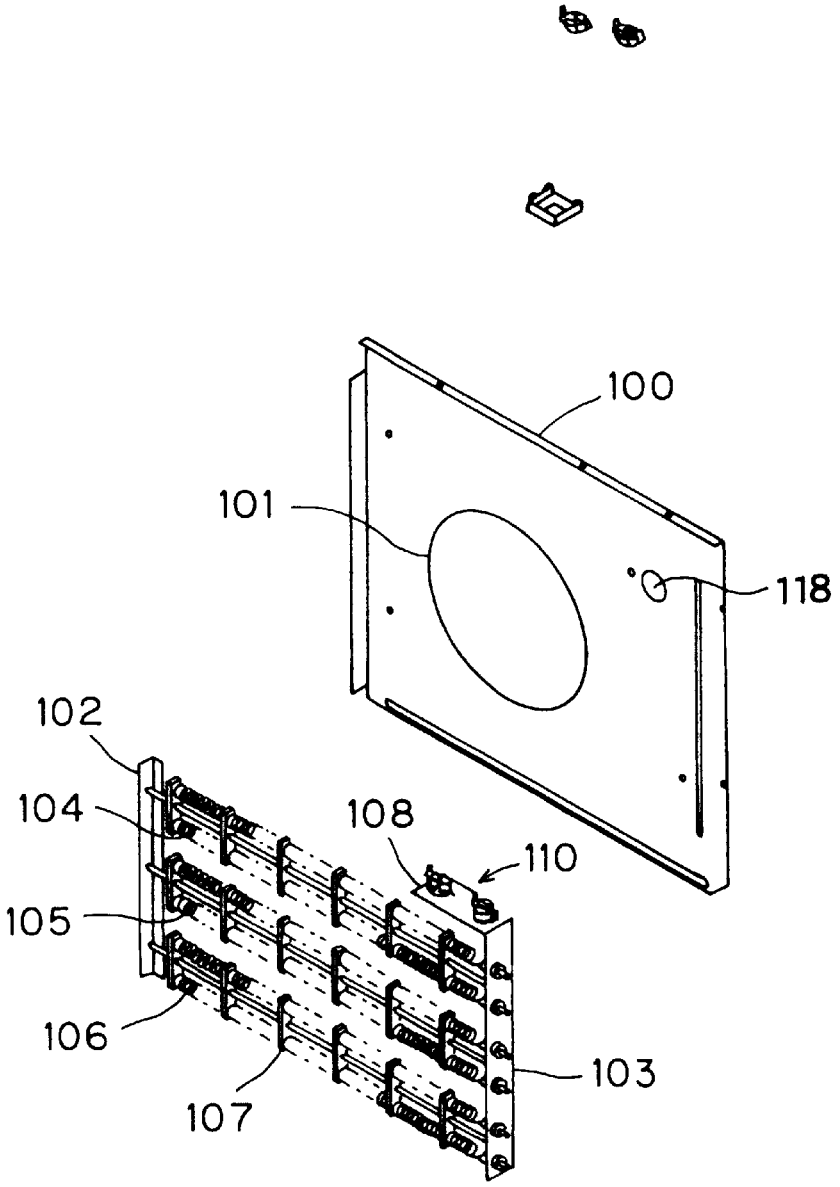
FIG. 18 is an exploded perspective view of the heating means.
Figure 20:
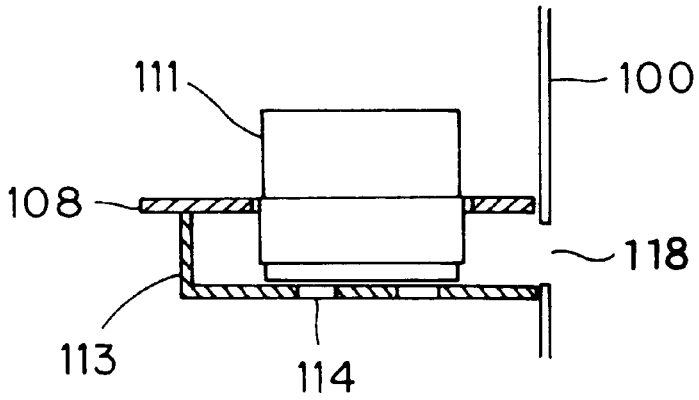
FIG. 20 is an enlarged sectional view of a portion of the temperature sensing portion.
Figure 21:
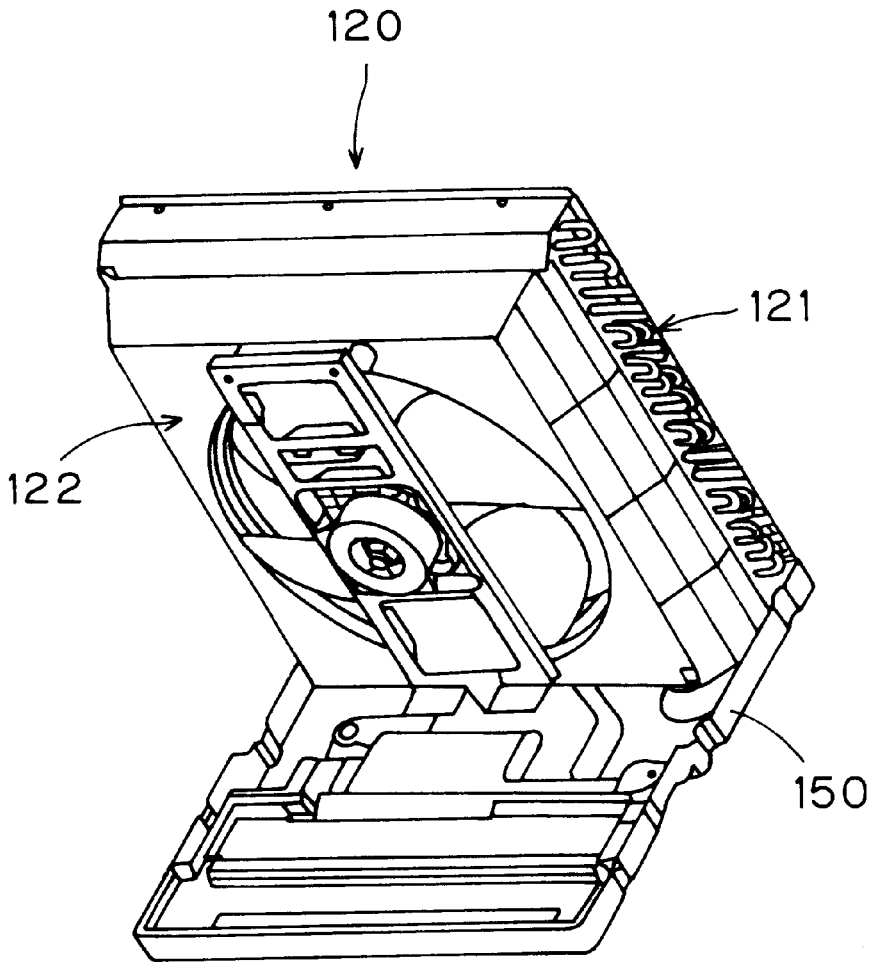
FIG. 21 is a perspective view of the outdoor heat exchanger unit of the cooler/heater unit in its state combined with the base.
Figure 22:
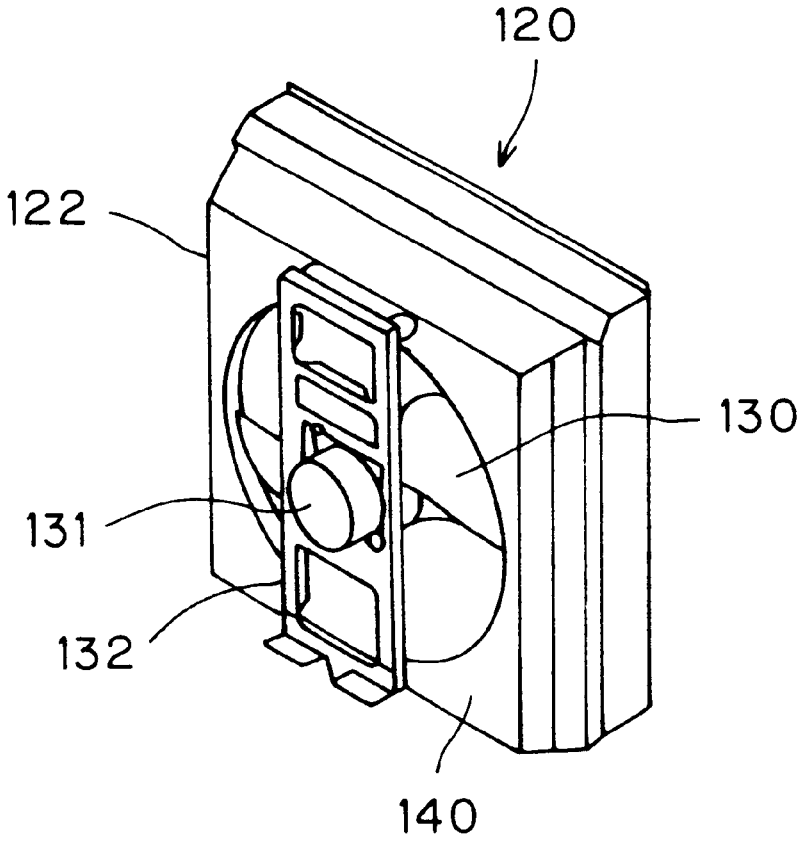
FIG. 22 is a perspective view of the outdoor heat exchanger unit.

The container 113 is so shaped as to be open toward the orifice plate 100, and in the corresponding portion of the orifice plate 100 is formed a vent opening 118 (see FIGS. 18 and 20). The vent opening 118 is located on the outflow side of the sirocco fan 80. Therefore, as the sirocco fan 80 rotates, the pressure on the rear side of the vent opening 118 rises, and thus air flows from the fan chamber 96 to the container 113 through the vent opening 118. The air that has flowed into the container 113 flows out of it through a vent opening 114 (see FIG. 20) formed in the bottom surface thereof to in front of the orifice plate 100.

Figure 16:
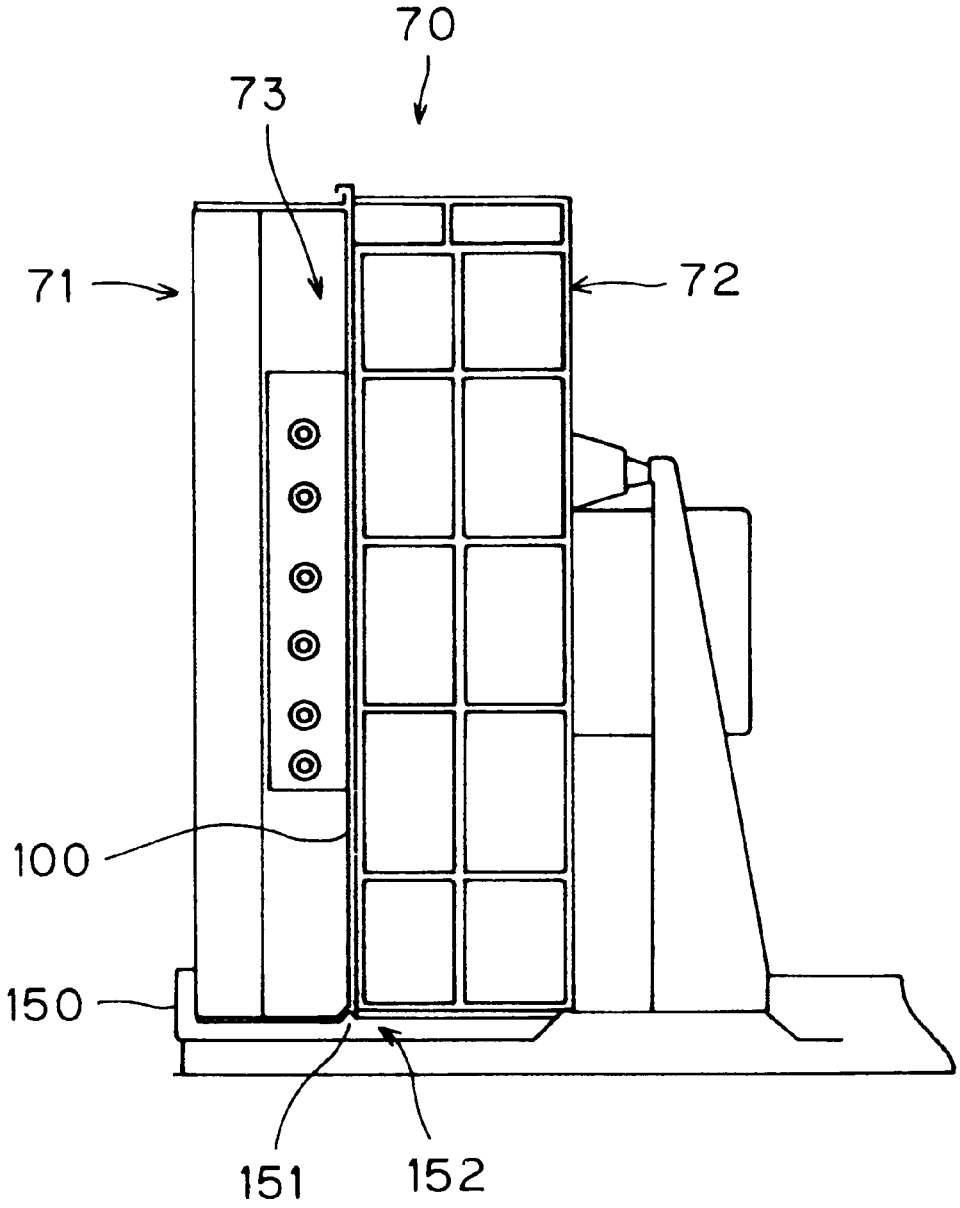
FIG. 16 is a side view of the indoor heat exchanger unit.

The heating means 73 is fitted as follows. As shown in FIG. 16, on the base 150, an elevated portion 151 is formed with a short interval secured in front of the front face of the indoor blower 72. The elevated portion 151 extends in the direction of the depth of the figure, and thereby forms an engagement recess 152 between itself and the indoor blower 72. In this engagement recess 152, the bottom end of the orifice plate 100 is fitted. Then, the top end of the orifice plate 100 is fixed to the fan casing 90 with unillustrated screws. In this way, the orifice plate 100 is fixed only at one end with screws, and thus the heating means 73 can be fixed with a few screws.

The orifice plate 100 is kept in close contact with the front face of the fan casing 90, and thus serves as the front plate of the fan chamber 96. The orifice plate 100 may be fixed with screws to any other component than the fan casing 90 inside the housing 10 as long as the component can support the orifice plate 100.

Figure 13:
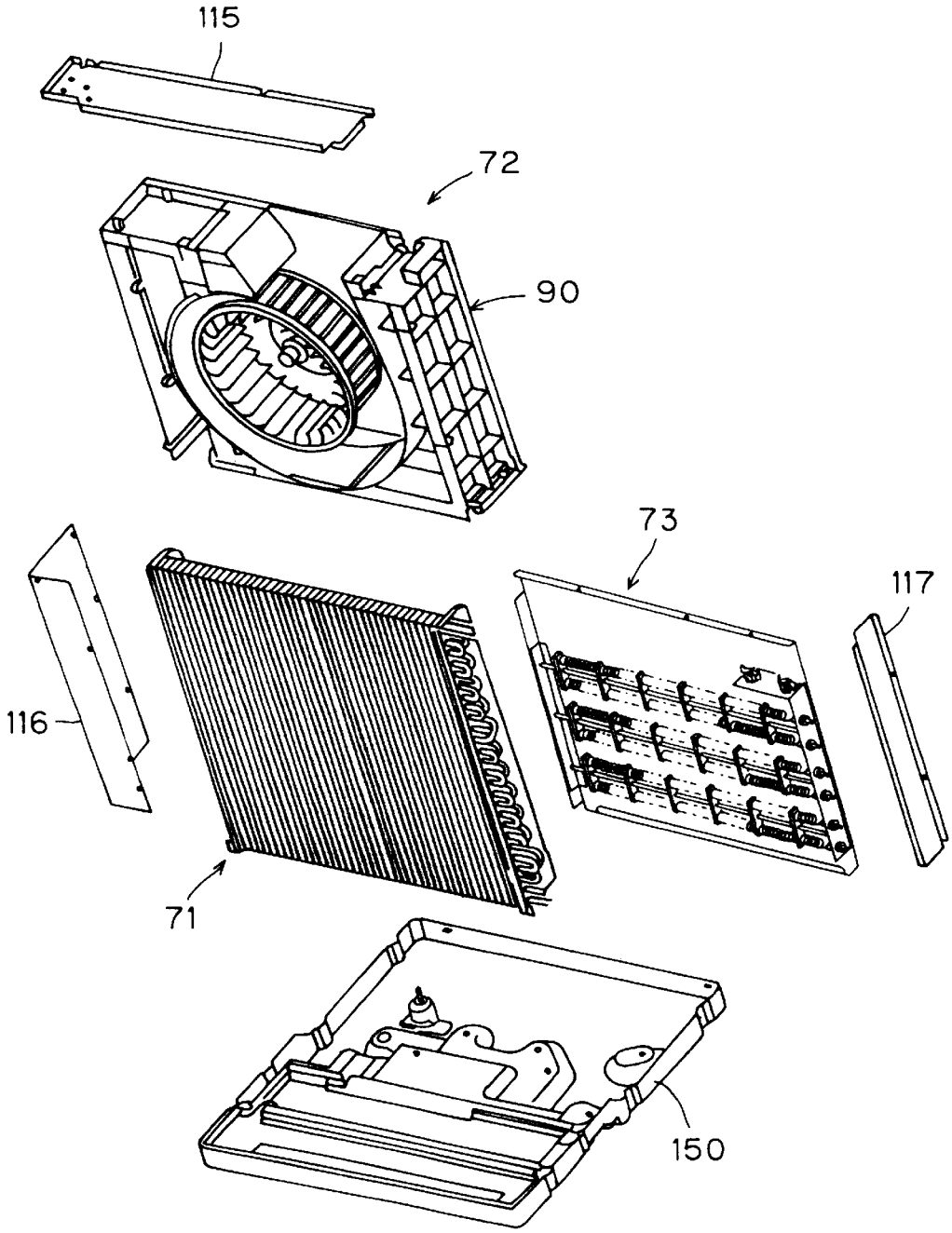
FIG. 13 is an exploded perspective view of the indoor heat exchanger unit of the cooler/heater unit.

After the heating means 73 is fixed in this way, the space between the indoor heat exchanger 71 and the indoor blower 72 is enclosed with three metal plates shown in FIG. 13, specifically, a top plate 115, a left plate 116, and a right plate 117. The wind passage from the indoor heat exchanger 71 to the indoor blower 72 is thus enclosed from around. This permits all the air heated by the heating means 73 to be sucked by the indoor blower 72 without leaking to outside.

Next, the structure of the outdoor heat exchanger unit 120 will be described in detail with reference to FIGS. 21 to 24.

The outdoor heat exchanger unit 120 is composed essentially of an outdoor heat exchanger 121 and an outdoor blower 122. These both have a rectangular shape as seen from the front, and they are arranged in the following order from the front to the rear: the outdoor blower 122 and the outdoor heat exchanger 121.

Figure 23:
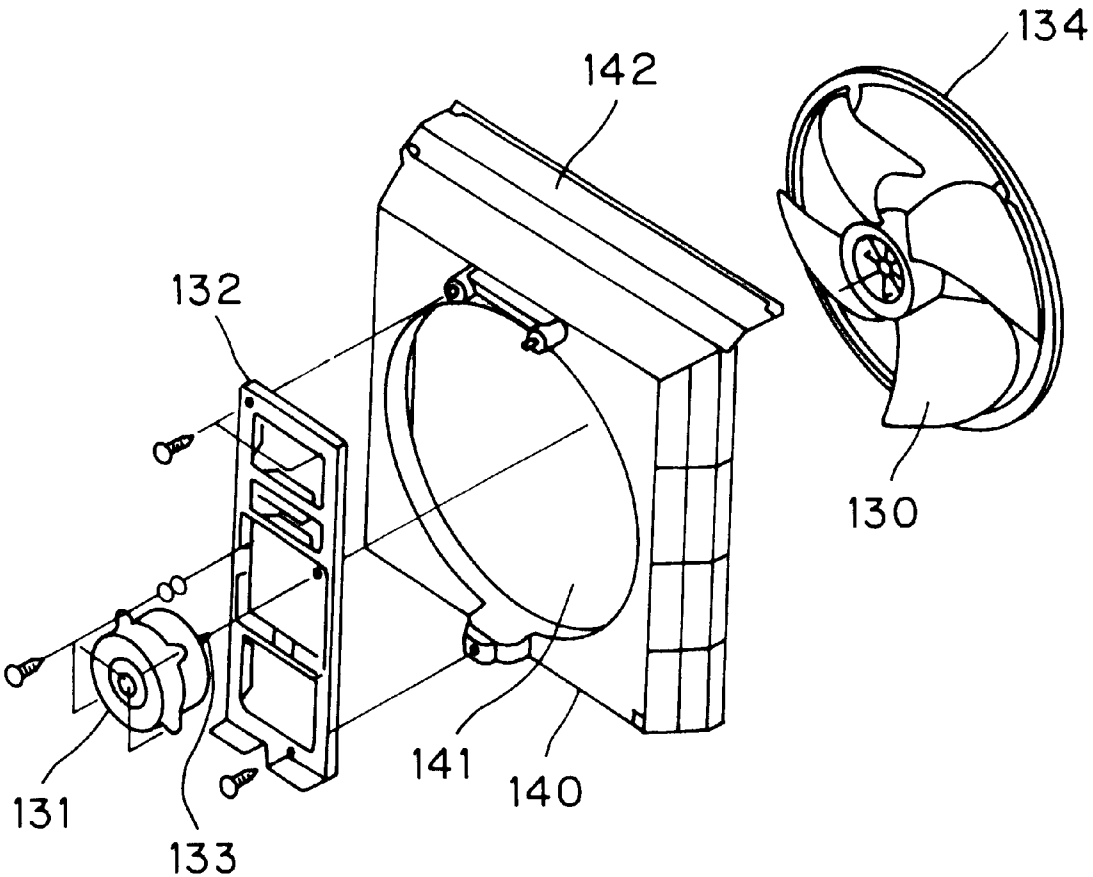
FIG. 23 is an exploded perspective view of the outdoor blower of the cooler/heater unit.

As shown in FIG. 23, the outdoor blower 122 is provided with a propeller fan 130, a motor 131 for rotating the propeller fan 130, and a fan casing 140. The motor 131 is fixed to the fan casing 140 through a metal fitting frame 132, with a motor spindle 133 protruding to the rear side of the fan casing 140. The propeller fan 130 is fixed to the motor spindle 133 with a nut.

The fan casing 140 has a circular vent opening 141 that is slightly larger in diameter than the propeller fan 130, and the propeller fan 130 is arranged in this vent opening 141. The propeller fan 130 has a ring 134 formed integrally therewith. The ring 134 is located on the rear side of the vent opening 141, and is larger in diameter than the vent opening 141. The function of the ring 134 will be described later.

A top plate 142 protrudes rearward from the top end of the fan casing 140. The top plate 142 covers the top of the outdoor heat exchanger 121. By fastening the top plate 142 to the outdoor heat exchanger 121 with screws, the outdoor blower 122 and the outdoor heat exchanger 121 are coupled together at their top ends, and the gap between them is closed.

As shown in FIG. 2, there is space between the outdoor heat exchanger unit 120 and the wind guide 54. This space serves as an inflow passage 62 through which air is sucked in from outside the room.

Figure 24:
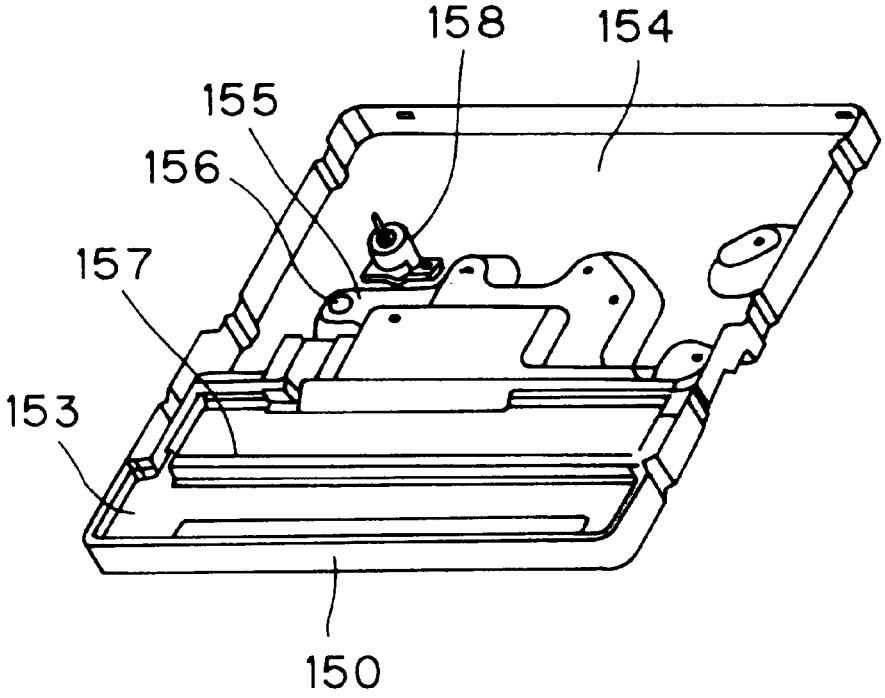
FIG. 24 is a perspective view of the base.

The ring 134 functions as follows. As shown in FIG. 24, the base 150 is shaped like a tray. The front portion of the base 150 is formed as a drain pan 153 for collecting drain water from the indoor heat exchanger 71, and the rear portion of the base 150 is formed as a drain pan 154 for collecting drain water from the outdoor heat exchanger 121. The drain pan 153 is formed by fitting a tray made of styrene foam in the base 150. The bottom surface of the drain pan 153 lies at a higher level than the bottom surface of the drain pan 154, so that all the drain water collected in the drain pan 153 flows into the drain pan 154.

In the drain pan 154 is formed an elevated portion 155 that lies at a higher level than the bottom surface of the drain pan 153, and in the top surface of the elevated portion 155 is formed an overflow opening 156. Thus, when water collects in the drain pan 154 to the level of the elevated portion 155, the water drops through the overflow opening 156 into the basin 24 on the bottom panel 11, and is then discharged from the water collecting sink 25 through the drain hose 30.

The bottom end of the ring 134 is dipped in the water collected in the drain pan 154. As the propeller fan 130 rotates, the ring 134 splashes water in the direction of centrifugal force, and the splashed water is carried by the flow of air blown from the propeller fan 130 to the outdoor heat exchanger 121 and reaches the outdoor heat exchanger 121. In cooling operation, the water that has reached the outdoor heat exchanger 121 vaporizes and absorbs heat of vaporization from the outdoor heat exchanger 121.

In the drain pan 153, a ridge-like drain cover 157 is provided. The drain cover 157 supports the bottom surface of the indoor heat exchanger 71, and prevents the indoor heat exchanger 71 from touching the drain pan 153.

In the drain pan 154, an antifreezing valve 158 is provided. The antifreezing valve 158 is normally closed, and opens when the room temperature falls below 5° C. to make all the water collected in the drain pan 154 drop onto the bottom panel 11 so that the water is discharged to outside. This prevents ice from forming in the drain pan 154.

Next, how the single-package air conditioner 1 is installed will be described.

The single-package air conditioner 1 may be shipped with the housing 10 and the cooler/heater unit 50 already combined together, or with these packed separately so as to be combined together at the installation site. When packed separately, the housing 10 may be packed in an assembled state or in a disassembled state. When packed separately, the cooler/heater unit 50 is packed in a fully assembled state as shown in FIG. 12

When the housing 10 is shipped in a disassembled state, it includes not only the bottom panel 11, top panel 12, front panel 13, rear panel 14, left side panel 15, and right side panel 16, but also the filter 21, duct 33, duct base 34, and heat insulating plate 41.

When the housing 10 is shipped in an assembled state, at the installation site, the unpacked housing 10 is simply mounted on the support stand 5. When it is shipped in a disassembled state, at the installation site, first the bottom panel 11, top panel 12, front panel 13, rear panel 14, left side panel 15, and right side panel 16 are fitted together with screws through predetermined steps to form the housing 10, and then the housing 10 is mounted on the support stand 5.

When the housing 10 is mounted on the support stand 5, one of the front panel 13, left side panel 15, and right side panel 16 is left removed. Which one to leave removed depends on the circumstances at the installation site; specifically, whichever is located in the direction from which the cooler/heater unit 50 can be inserted easily later is left removed.

After the housing 10 is mounted on the support stand 5, its position is adjusted so that the protruding portion 19 on the rear face thereof fits in the ventilation opening 3, and the heights of the adjustable feet 31 are adjusted to level the housing 10. Inside the housing 10, the fitting bolts 36 are rotated to raise the duct base 34 to its highest position. The air conditioning duct 6 is connected to the duct 33. The water collecting sink 25 is fitted on the bottom panel 11, and the drain hose 30 is connected to the water collecting sink 25.

After the connection of the air conditioning duct 6 and the drain hose 30, the cooler/heater unit 50 is inserted in the housing 10. After insertion, the cooler/heater unit 50 is pressed toward the rear panel 14 so that the rim on the rear face thereof (i.e. the rear edges of the wind guide 54, left side plate 160, right side plate 161, and the base 150) is pressed against the gasket 18 (see FIG. 2). As a result, a hermetic connection portion is formed between the vent opening 17 and the cooler/heater unit 50. The hermetic connection here reduces the leakage of wind, and thus helps make efficient use of energy.

After the cooler/heater unit 50 is hermetically connected to the vent opening 17, the cooler/heater unit 50 is fixed to the housing 10 with unillustrated screws.

Then, the fitting bolts 36 are rotated to lower the duct 33 and the duct base 34 so that the gasket 61 is brought into close contact with the upper rim of the wind duct 55. As a result, the wind duct 55 and the duct 33 are hermetically connected together.

Thereafter, the panel that has been left removed is fitted with screws to bring the housing 10 into a fully assembled state. Then, the filter 21 is fitted into the filter holder 22.

Next, the operation of the single-package air conditioner 1 will be described.

When the operation of the single-package air conditioner 1 is started, the indoor blower 72 and the outdoor blower 122 starts producing wind. The indoor blower 72 sucks in indoor air into the housing 10 through the filter 21. The indoor air thus sucked in passes through the indoor heat exchanger 71 and the heating means 73, is then sucked by the indoor blower 72, and is then blown out through the outflow opening 97. The air thus blown out passes through the wind duct 55 and the duct 33, and is then sent into the air conditioning duct 6.

The outdoor blower 122 sucks in outdoor air into the housing 10 through the inflow passage 62. The outdoor air thus sucked in is blown toward the outdoor heat exchanger 121 by the outdoor blower 122 so that the air then passes through the outdoor heat exchanger 121 and flows out of the room.

In cooling operation, a refrigerant compressed by the compressor 52 and thereby heated is fed to the outdoor heat exchanger 121. In the outdoor heat exchanger 121, the outdoor air blown by the outdoor blower 122 absorbs the heat of the refrigerant. Thus, the refrigerant is cooled and thereby liquefied.

The liquefied refrigerant passes through an unillustrated expansion valve, and then vaporizes inside the indoor heat exchanger 71, thereby cooling the indoor heat exchanger 71. The indoor air sucked into the housing 10 by the indoor blower 72, as it passes through the indoor heat exchanger 71, is cooled as a result of its heat being absorbed. The cooled air is sent out through the air conditioning duct 6 to predetermined rooms to achieve cooling in those rooms.

In heating operation, the refrigerant is circulated in the reverse direction. The refrigerant condensed by the compressor 52 and thereby heated is fed to the indoor heat exchanger 71 so that the indoor air passing through the indoor heat exchanger 71 is heated to produce warm air. The refrigerant passes through the unillustrated expansion valve, and then vaporizes inside the outdoor heat exchanger 121, thereby cooling the outdoor heat exchanger 121. As the outdoor blower 122 blows the outdoor air to the outdoor heat exchanger 121, heat is exchanged between the vaporized refrigerant and the outdoor air, with the refrigerant absorbing heat from the outdoor air. Having achieved heating in this way, the refrigerant returns to the compressor 52.

In heating operation, the heating means 73 is energized as well so that the air that has been heated to a certain degree by receiving heat from the indoor heat exchanger 71 is further heated.

Depending on the target temperature of heating, appropriate ones among the heaters 104, 105, and 106 are energized. When temperature is low, or when heating operation has just started and therefore the temperature in the room needs to be raised quickly, all the heaters 104, 105, and 106 are energized.

Irrespective of the number of heaters energized, when any of the heaters is energized, the temperature sensing means 110 is hit by radiated heat and a flow of hot air. The thermostat 111 monitors the rising and falling of temperature to turn off and on the energization of the heaters 104, 105, and 106. On the other hand, the thermostat 112, on detection of abnormal temperature, stops the energization of the heaters 104, 105, and 106.

The thermostat 112, which monitors abnormal temperature, has its temperature sensing portion exposed directly to radiated heat and a flow of hot air. By contrast, the thermostat 111, which monitors the rising and falling of temperature, is exposed, in normal operation, only to the flow of hot air that flows in from the fan chamber 96 through the vent opening 118.

The thermostat 111 is inherently susceptible to the heat radiated from the uppermost heater 104. However, here, the container 113 cuts radiated heat so that the thermostat 111 monitors only the temperature of the flow of air that flows in through the vent opening 118. This flow of air results from the air having passed through the heaters 104, 105, and 106 being collected in the fan chamber 96 through the vent opening 101 of the orifice plate 100 and then agitated by the sirocco fan 80. Accordingly, in this flow of air, the heat received from the heaters is distributed substantially uniformly. Thus, irrespective of whether all the heaters 104, 105, and 106 are energized or any of them is left unenergized, the thermostat 111 permits stable monitoring of temperature with satisfactory accuracy.

When the indoor blower 72 breaks down and the sirocco fan 80 stops rotating (i.e. when the fan is locked), the flow of air through the vent opening 118 into the container 113 stops. Then, the heat radiated from the heaters and the flow of hot air therefrom come in through the vent opening 114 and heat the temperature sensing portion of the thermostat 111. As a result, the thermostat 111 detects abnormal generation of heat, and thus turns the heaters off.

In cooling operation, drain water drops from the indoor heat exchanger 71. In heating operation, drain water drops from the outdoor heat exchanger 121. The drain water is collected in the drain pan 153 or the drain pan 154 to form a pool of water in the drain pan 154. As described earlier, this pool of water is used to cool the outdoor heat exchanger 121.

In the event of failure or malfunctioning of the cooler/heater unit 50, whichever of the front panel 13, left side panel 15, and right side panel 16 is most convenient for the removal of the cooler/heater unit 50 is removed, and, through the face thus opened, the cooler/heater unit 50 is taken out for checking.

When it is certain that something is wrong with the heating means 73, the left plate 116 or right plate 117 is removed, then the screws that fasten the top end of the orifice plate 100 are removed, and then the bottom end of the orifice plate 100 is disengaged from the engagement recess 152. In this way, the heating means 73 can be removed through either of the left and right side faces of the housing 10. This makes the checking and repair of the heating means easy even when the single-package air conditioner 1 is installed in a corner of a room. The heating means 73 can be fitted back in position by performing the steps described just above in the reverse order.

In the event of malfunctioning of the sirocco fan 80 of the indoor blower 72, when the guide member 95 is removed from the casing body 91, the outflow opening 97 comes to have a width W larger than the diameter of the sirocco fan 80. Then, the sirocco fan 80 can be removed from the motor spindle 83 and taken out through this opening for necessary maintenance. Thus, there is no need to touch the components arranged in front of the indoor blower 72, specifically the indoor heat exchanger 71 and the heating means 73.

Next, how the draft resistance and blowing noise of outdoor and/or indoor air passages are reduced in a single-package air conditioner will be described. The descriptions given hereinafter are based on a second embodiment shown in FIG. 25 and a third embodiment shown in FIG. 26, but, before that, the problems that arise if the present invention is not carried out will be described with reference to FIG. 27.

Figure 27:
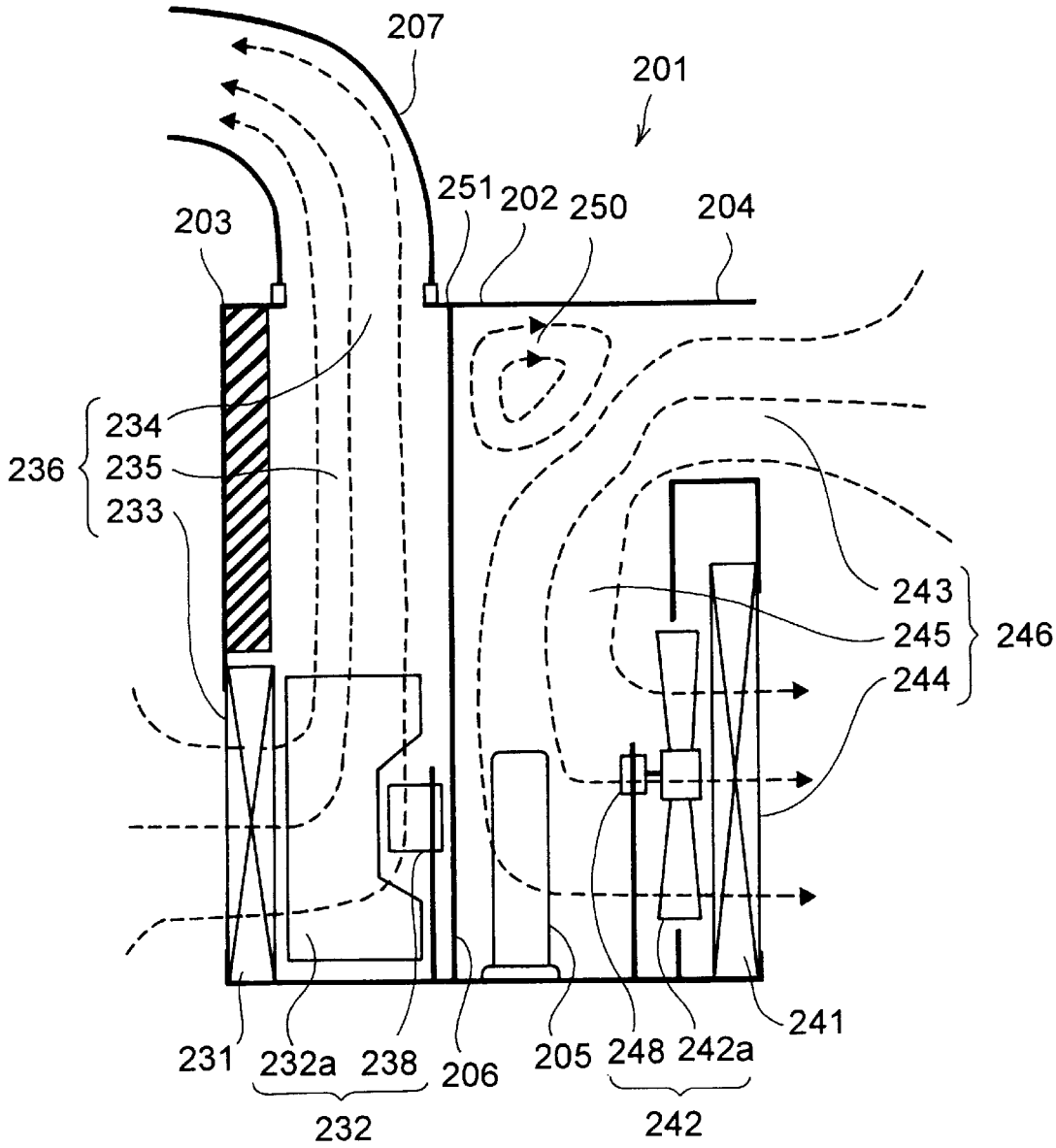
FIG. 27 is a vertical sectional view of a single-package air conditioner having a conventional structure.

FIG. 27 shows a single-package air conditioner 201 having a housing 202. Inside the housing 202 are provided an indoor heat exchanger unit 203 that exchange heat with the air inside a room, an outdoor heat exchanger unit 204 that exchanges heat with the air outside the room, and a compressor 205 that compresses a refrigerant sealed therein. The compressor 205 forms part of a refrigerating cycle.

The indoor heat exchanger unit 203 is provided with an indoor heat exchanger 231, an indoor blower 232, an indoor inflow opening 233, an indoor outflow opening 234, and an air passage 235.

The indoor heat exchanger 231 is arranged between the indoor blower 232 and the indoor inflow opening 233. Inside the indoor heat exchanger 231 is provided a passage (not illustrated) through which the refrigerant is circulated, so that heat is exchanged between the wind produced as the indoor blower 232 is operated and the refrigerant.

The indoor blower 232 is composed of a motor 238 and a fan 232*a* fitted thereto. As the motor 238 is driven, the fan 232*a* rotates, producing wind to be sent out into the room. The indoor blower 232 is arranged in a lower position in the indoor heat exchanger unit 203. On the bottom surface of the indoor heat exchanger unit 203 is arranged a fixing member for fixing the motor 238 at a predetermined level. By mounting the motor 238 on this fixing member, the indoor blower 232 is supported in a position close to the bottom surface of the indoor heat exchanger unit 203. The fan 232*a* is a sirocco fan.

The indoor inflow opening 233 is an opening formed in a side face of the housing 202. The indoor inflow opening 233 is arranged so as to face a partitioning member 206 (which will be described in detail later), and serves to guide the wind sucked in by the indoor blower 232. The side face of the housing in which the indoor inflow opening 233 is formed is perpendicular to the spindle of the motor 238 (i.e. parallel to the direction of a diameter of the fan 232*a*). The motor 238 faces the indoor inflow opening 233 with the fan 232*a* placed in between. The indoor inflow opening 233 has a rectangular shape, with two horizontal sides and two vertical sides.

The indoor outflow opening 234 is an opening formed in the top face of the housing 202. The indoor outflow opening 234 is located above the indoor blower 232, so that the wind produced by the indoor blower 232 is blown out through the indoor outflow opening 234. To the indoor outflow opening 234 is connected an air conditioning duct 207 that leads to a predetermined position inside the room.

The space that is enclosed by the housing 202 and the partitioning member 206 and through which the indoor inflow opening 233 and the indoor outflow opening 234 communicate with each other is the air passage 235. When the indoor blower 232 is driven, wind is produced that flows from the indoor inflow opening 233 through the air passage 235 to the indoor outflow opening 234. The indoor inflow opening 233, the air passage 235, and the indoor outflow opening 234 together form an indoor air passage 236.

Next, the structure of the outdoor heat exchanger unit 204 will be described. The outdoor heat exchanger unit 204 is provided with an outdoor heat exchanger 241, an outdoor blower 242, an outdoor inflow opening 243, an outdoor outflow opening 244, and an air passage 245.

The outdoor heat exchanger 241 is arranged between the outdoor blower 242 and the outdoor outflow opening 244. Inside the outdoor heat exchanger 241 is provided a passage (not illustrated) through which the refrigerant is circulated, so that heat is exchanged between the wind produced as the outdoor blower 242 is operated and the refrigerant.

The outdoor blower 242 is composed of a motor 248 and a fan 242*a* fitted thereto. As the motor 248 is driven, the fan 242*a* rotates, producing wind to be sent out to outside the room. The outdoor blower 242 is arranged in a lower position in the outdoor heat exchanger unit 204. On the bottom surface of the outdoor heat exchanger unit 204 is arranged a fixing member for fixing the motor 248 at a predetermined level. By mounting the motor 248 on this fixing member, the outdoor blower 242 is supported in a position close to the bottom surface of the outdoor heat exchanger unit 204. The fan 242*a* is a propeller fan.

The outdoor inflow opening 243 is an opening formed in a side face of the housing 202. The outdoor inflow opening 243 is arranged above the outdoor blower 242 so as to face the partitioning member 206. The outdoor inflow opening 243 serves to guide the wind sucked in by the outdoor blower 242. The outdoor inflow opening 243 has a rectangular shape, with two horizontal sides and two vertical sides.

The outdoor outflow opening 244 is arranged in a position opposing the indoor inflow opening 233. The outdoor outflow opening 244 is located on the downstream side of the outdoor blower 242, so that the wind produced by the outdoor blower 242 is blown out through the outdoor outflow opening 244.

The space that is enclosed by the housing 202 and the partitioning member 206 and through which the outdoor inflow opening 243 and the outdoor outflow opening 244 communicate with each other is the air passage 245. When the outdoor blower 242 is driven, wind is produced that flows from the outdoor inflow opening 243 through the air passage 245 to the outdoor outflow opening 244. The outdoor inflow opening 243, the air passage 245, and the outdoor outflow opening 244 together form an outdoor air passage 246.

The partitioning member 206 is a plate-shaped member provided so as to extend from the bottom face to the top face of the housing 202, and serves to separate the air passage 235 and the air passage 245.

The compressor 205 circulates the refrigerant between the indoor heat exchanger 231 and the outdoor heat exchanger 241 to make the refrigerating cycle of the single-package air conditioner function. The compressor 205 is arranged between the partitioning member 206 and the outdoor blower 242.

In the above descriptions, the directions are defined as follows. In the housing 202, the surface thereof on which the compressor 205 is arranged is the "bottom surface." The single-package air conditioner is installed at the installation site with the bottom surface of the housing 202 down in the direction of a plum line.

The surface of the housing 202 opposing the bottom surface thereof is the "top surface" thereof. When a vertical direction is dealt with, the direction from the bottom surface to the top surface is referred to as the upward direction, and the direction from the top surface to the bottom surface is referred to as the downward direction. A horizontal direction denotes a direction perpendicular to a vertical direction.

Now, how the single-package air conditioner 201 structured as described above achieves cooling in a room will be described.

In cooling operation, as the compressor 205 is driven, a refrigerating cycle functions, in which the indoor heat exchanger 231 functions as an evaporator and the outdoor heat exchanger 241 functions as a condenser. Thus, the indoor heat exchanger 231 becomes colder and the outdoor heat exchanger 241 becomes hotter.

Here, when the indoor blower 232 is driven, indoor air is sucked in through the indoor inflow opening 233. The air thus sucked in, as it passes through the indoor heat exchanger 231, exchanges heat and becomes colder. The cooled air is then sucked by the indoor blower 232, is then blown out into the air passage 235, and is then sent from the indoor outflow opening 234 through the air conditioning duct 207 to a predetermined position inside the room. In this way, the inside of the room is cooled. In FIG. 27, the flow of air in this operation is indicated by broken-line arrows in the indoor air passage 236.

When the outdoor blower 242 is driven simultaneously, outdoor air is sucked in through the outdoor inflow opening 243. The air thus sucked in is sent through the air passage 245 to the outdoor blower 242. The air is then sucked by the outdoor blower 242, and is then blown out toward the outdoor heat exchanger 241. As the air passes through the outdoor heat exchanger 241, it exchanges heat therewith and is thereby heated. The heated air is then blown out through the outdoor outflow opening 244. In FIG. 27, the flow of air in this operation is indicated by broken-line arrows in the outdoor air passage 246.

Heating operation differs from cooling operation only in that the evaporator and the condenser exchange their roles, and therefore will not be described in any more detail.

In the single-package air conditioner 201, the top surface of the housing 202 and the partitioning member 206 are joined together substantially perpendicularly at a joint 251. This produces a rectangular corner between the top surface and the partitioning member 206. As air passes through the outdoor air passage 246, it produces an eddy of wind 250 in this corner. This increases the draft resistance of the outdoor air passage 246, and also increases blowing noise.

Also with the indoor air passage 236, no measures are taken to reduce draft resistance, the only measure taken to reduce blowing noise being to line the inner surface of the indoor air passage 236 with a sound absorbing material.

The second and third embodiments of the present invention are improved versions of the conventional structure shown in FIG. 27. Hereinafter, the second embodiment will be described with reference to FIG. 25, and the third embodiment will be described with reference to FIG. 26. The structures of the second and third embodiments are basically the same as the conventional one shown in FIG. 27, and therefore, in the following descriptions, only differences from the conventional structure will be explained, and such portions as are found also in the conventional structure will not be explained again.

Figure 25:
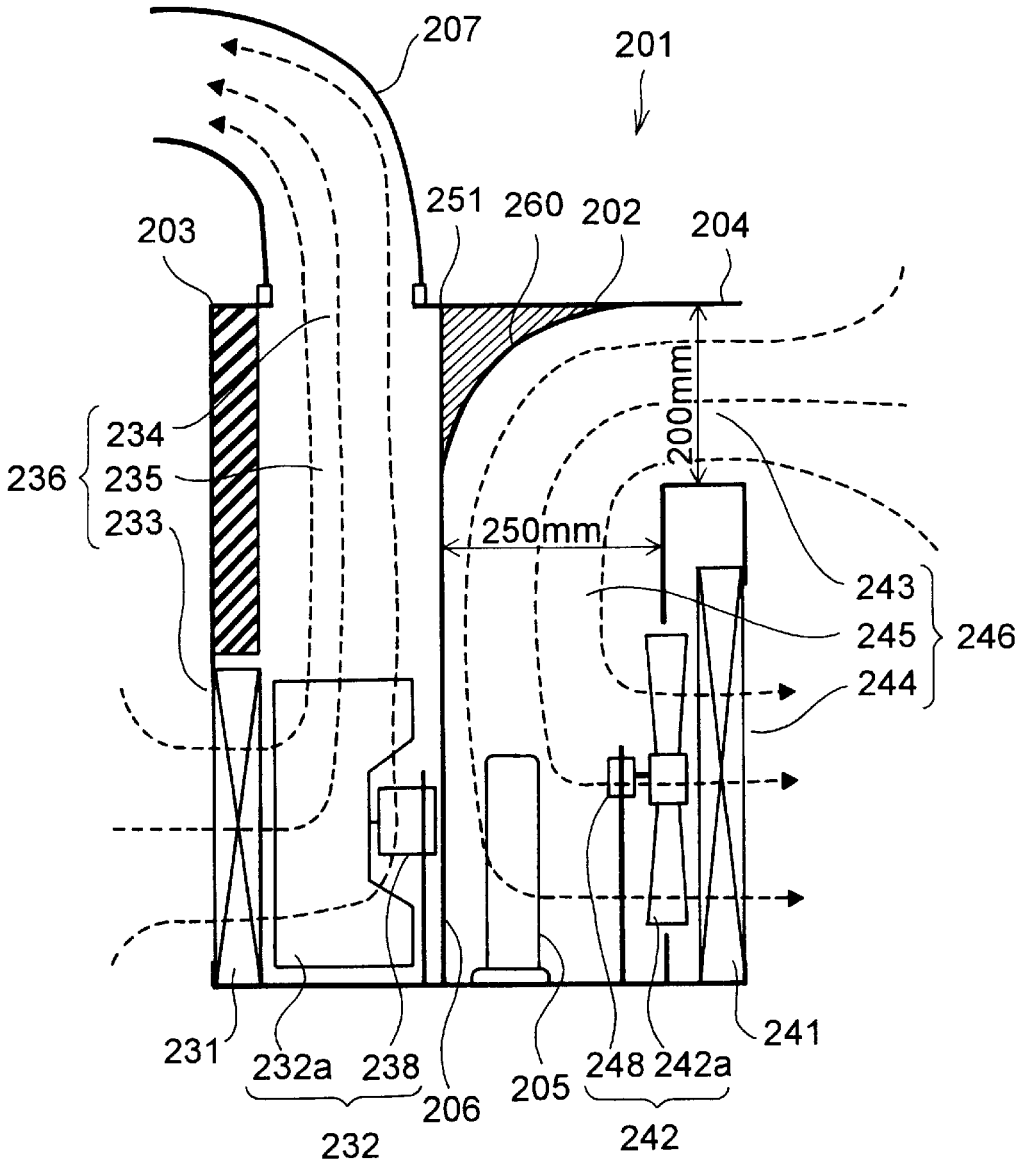
FIG. 25 is a vertical sectional view of the single-package air conditioner of a second embodiment of the invention.

In the second embodiment shown in FIG. 25, the portion of the partitioning member 206 that faces the outdoor inflow opening 243 is formed into a curved-surface portion 260. That is, a curved surface having a sectional shape as appears in the figure extends in the depth direction of the figure. The curved-surface portion 260 serves to smoothly guide the air sucked in through the outdoor inflow opening 243 to the air passage 245.

The shape of the curved-surface portion 260 is obtained by bending the upper portion of the partitioning member 206 into a shape of which the section is composed of a single arc, or a shape of which the section is composed of a plurality of arcs joined together. Alternatively, it may be formed by combining together a plurality of minute planes at gradually varying angles into a shape of which the section is analogous to an arc.

When the outdoor blower 242 is driven, wind is produced in the outdoor air passage 246 which flows as indicated by broken-line arrows in FIG. 25. The air sucked in through the outdoor inflow opening 243 is guided by the curved-surface portion 260 of the partitioning member 206, and thus changes its direction smoothly while flowing in the air passage 245. The eddy of wind 250 that is produced in the conventional structure is not produced in the vicinity of the curved-surface portion 260 here. Thus, as compared with the conventional structure, it is possible to reduce draft resistance and also lower the level of the blowing noise.

Figure 26:
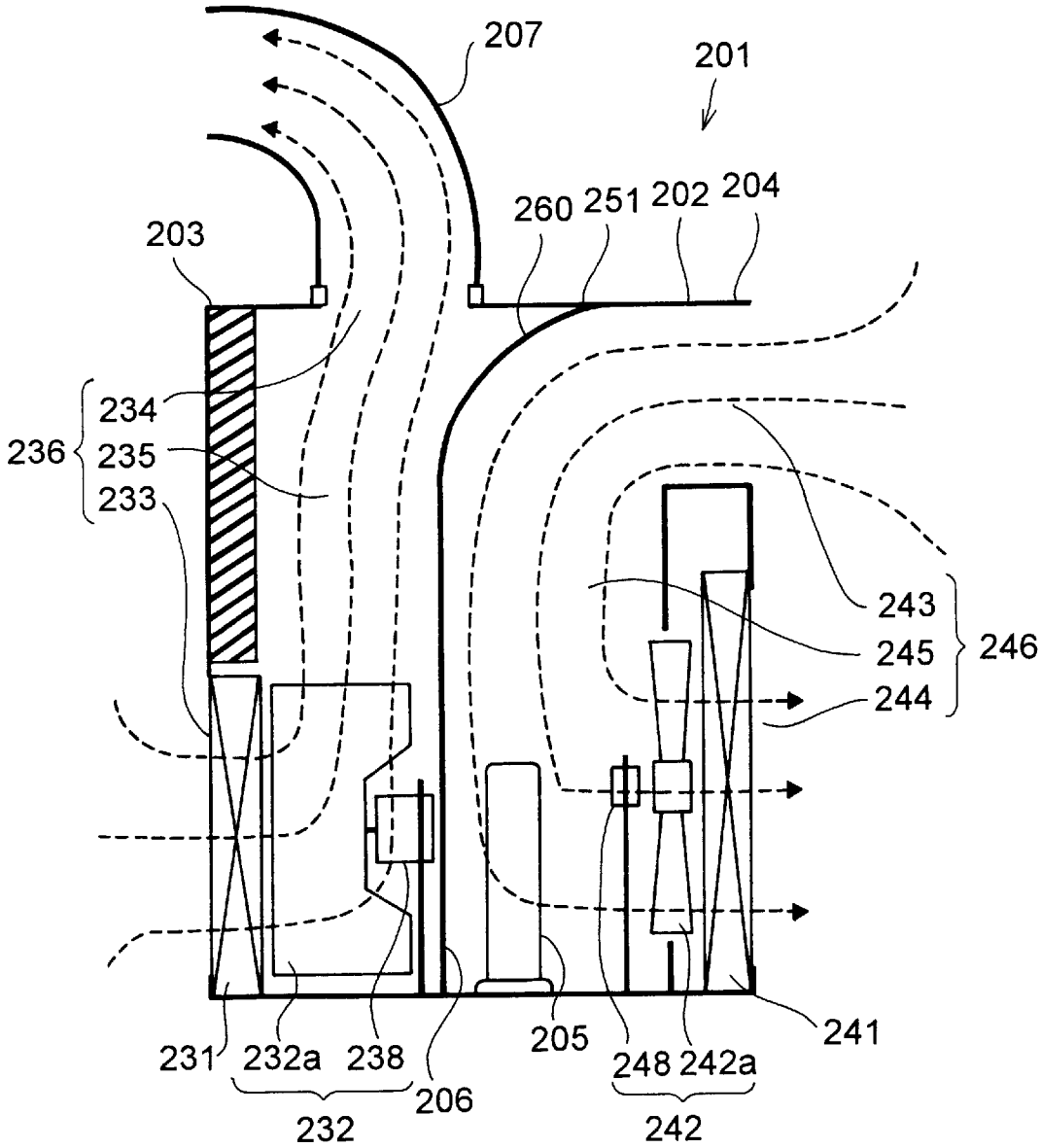
FIG. 26 is a vertical sectional view of the single-package air conditioner of a third embodiment of the invention.

In the third embodiment shown in FIG. 26, as in the second embodiment, a curved-surface portion 260 is provided on the partitioning member 206. The difference is that the shape of the curved-surface portion 260 shows toward the indoor air passage 236 as well, so that, inside the indoor air passage 236, the air passage 235 leading from the indoor blower 232 to the indoor outflow opening 234 becomes wider and wider gradually. This permits the curved-surface portion 260 to serve as a diffuser portion with respect to the indoor blower 232. This brings about a diffuser effect on the wind flowing through the indoor air passage 236, and thus helps reduce the draft resistance of the indoor blower 232.

The shape and dimensions of the curved-surface portion 260 are determined in the following manner, which is common to the second and third embodiment.

Let the dimension of the outdoor inflow opening 243 in the vertical direction be Ra, and the dimension of the outdoor air passage in the horizontal direction be Rb. Then, the radius R of the arc-shaped curved-surface portion 260 satisfies $$\min(Ra,Rb) \geqq R.$$

Moreover, $$Rb \geqq Ra \text{ and } R \approx Ra.$$

Practical examples will be presented. With Ra=200 mm and Rb=250 mm, the curved-surface portion 260 is given a sectional shape that is an arc with a radius of 200 mm. When these dimensions are applied to the single-package air conditioner 201 of the second embodiment, and it is operated with the indoor blower 232 producing wind at a rate of 10.6 $m^3$/min and the outdoor blower 242 at a rate of 16.5 $m^3$/min, then the measurement of blowing noise in this embodiment results in 3.1 dB less.

When the same dimensions are applied to the single-package air conditioner 201 of the third embodiment, and it is operated with the indoor blower 232 producing wind at a rate of 10.6 $m^3$/min and the outdoor blower 242 at a rate of 16.5 $m^3$/min, then the measurement of blowing noise resulted in 5.5 dB less.

In the descriptions above, the motor 238 of the indoor blower 232 and the motor 248 of the outdoor blower 242 are mounted on the fixing members. However, one or both of the fixing members may be omitted by mounting one or both of the motors 238 and 242 on the partitioning member 206.

It is to be understood that, in carrying out the present invention, many modifications and variations are possible within the scope of the invention.

What is claimed is:

1. A single-package air conditioner comprising:

a housing;

an indoor heat exchanger unit housed in the housing; and an outdoor heat exchanger unit housed in the housing, wherein the indoor heat exchanger unit and the outdoor heat exchanger unit together constitute a single cooler/heater unit;

the housing is connected to an air conditioner duct suspended from above; and the cooler/heater unit is removable from inside the housing with the housing kept connected to the air duct.

2. A single-package air conditioner as claimed in claim 1, wherein the housing has four side faces thereof formed of four panels, of which three other than one facing a wall are individually removable from the housing.

3. A single-package air conditioner as claimed in claim 1, wherein in the housing is provided a duct that connects to the air conditioning duct and whose height is variable inside the housing.

4. A single-package air conditioner as claimed in claim 1, wherein the cooler/heater is provided with a drain pan for collecting drain water produced in the cooler/heater unit, and the housing is provided with a water collecting sink for collecting and discharging the drain water from the drain pan of the cooler/heater unit.

5. A single-package air conditioner as claimed in claim 1, wherein the housing is connected to the air conditioning duct with or without the cooler/heater unit housed in the housing.

6. A single-package air conditioner as claimed in claim 1, wherein the housing is connected to a drain hose with or without the cooler/heater unit housed in the housing.

7. A single-package air conditioner comprising:

a housing; and a removable cooler/heater unit housed in the housing, wherein the cooler/heater unit includes a blower fan casing; and a component forming part of the blower fan casing is removable, such that when the component is removed an opening provides sufficient access to enable removal of a fan provided inside the blower fan casing.

8. A single-package air conditioner comprising:

a housing;

a cooler/heater unit housed in the housing; and heating means, arranged inside the housing, for heating, wherein the heating means is removable through either of left-hand and right-hand side faces of the housing.

9. A single-package air conditioner as claimed in claim 8, wherein the heating means is fixed in position with one end thereof engaged with an engagement recess inside the housing and with another end thereof fastened with a screw to a member provided inside the housing.

10. A single-package air conditioner as claimed in claim 8, wherein temperature sensing means for controlling energization of the heating means is arranged above the heating means, the temperature sensing means having a temperature sensing portion thereof housed in a container having a vent through which to allow a flow of hot air in from the heating means.

11. A single-package air conditioner comprising:

a housing; and a cooler/heater unit housed in the housing, wherein a hermetic connection portion is formed between a vent opening formed in the housing and the cooler/heater unit.

12. A single-package air conditioner comprising:

a housing;

an indoor heat exchanger, housed in the housing, for exchanging heat with air inside a room;

an indoor blower, housed in the housing, for blowing air into the room;

an indoor air passage, housed in the housing, through which wind produced by the indoor heat exchanger is passed;

an outdoor heat exchanger, housed in the housing, for exchanging heat with air outside the room;

an outdoor blower, housed in the housing, for blowing air out of the room;

an outdoor air passage, housed in the housing, through which wind produced by the outdoor heat exchanger is passed; and a partitioning member for partitioning at least part of the indoor and outdoor air passages, wherein the partitioning member has a portion thereof formed into a curved-surface portion for guiding the wind passing through one of the indoor and outdoor air passages, and wherein the curved-surface portion is structured as a diffuser portion for diffusing the wind passing through the other of the indoor and outdoor air passages.

13. A single-package air conditioner comprising:

a housing;

an indoor heat exchanger, housed in the housing, for exchanging heat with air inside a room;

an indoor blower, housed in the housing, for blowing air into the room;

an indoor air passage, housed in the housing, through which wind produced by the indoor heat exchanger is passed;

an outdoor heat exchanger, housed in the housing, for exchanging heat with air outside the room;

an outdoor blower, housed in the housing, for blowing air out of the room;

an outdoor air passage, housed in the housing, through which wind produced by the outdoor heat exchanger is passed; and a partitioning member for partitioning at least part of the indoor and outdoor air passages, wherein the partitioning member has a portion thereof formed into a curved-surface portion for guiding the wind passing through one of the indoor and outdoor air passages, and wherein the curved-surface portion faces an outdoor inflow opening, and has an arc-shaped section whose radius R satisfies $$\min(Ra,Rb) \geqq R,$$

where Ra represents a dimension of a portion of the outdoor inflow opening facing the partitioning member and Rb represents a dimension of the outdoor air passage.

14. A single-package air conditioner as claimed claim 13, wherein the following conditions are additionally satisfied:

$$Rb \geqq Ra \text{ and } R \approx Ra.$$

* * * * *